US005619746A

United States Patent [19]

Kubo et al.

[11] Patent Number: 5,619,746

[45] Date of Patent: Apr. 8, 1997

[54] IMAGE FORMING APPARATUS HAVING RECORDING MATERIAL BEARING MEMBER

[75] Inventors: Takahiro Kubo, Tokyo; Yoshihiro Murasawa, Yokohama; Hisashi Fukushima, Kawasaki; Takeshi Menjo, Tokyo; Takashi Hasegawa, Ageo; Satoshi Tamura, Yokohama, all of Japan

[73] Assignee: Canon Kabushiki Kaisha, Tokyo, Japan

[21] Appl. No.: 281,617

[22] Filed: Jul. 28, 1994

[30] Foreign Application Priority Data

Jul. 30, 1993 [JP] Japan ..... 5-208313
Jul. 30, 1993 [JP] Japan ..... 5-208314

[51] Int. Cl.[6] ..... G03G 15/14

[52] U.S. Cl. ..... 399/297; 399/101

[58] Field of Search ..... 355/271, 272, 355/274, 275, 311, 319, 24

[56] References Cited

U.S. PATENT DOCUMENTS

| | | | |
|---|---|---|---|
| 5,006,900 | 4/1991 | Baughman et al. | 355/271 |
| 5,057,873 | 10/1991 | Sawai et al. | 355/271 |
| 5,086,318 | 2/1992 | Takeda et al. | 355/271 |
| 5,335,056 | 8/1994 | Muramatsu | 355/327 |
| 5,386,278 | 1/1995 | Maeyama et al. | 355/271 |
| 5,414,501 | 5/1995 | Miura et al. | 355/271 |

FOREIGN PATENT DOCUMENTS

| | | | |
|---|---|---|---|
| 0488147 | 6/1992 | European Pat. Off. | 355/274 |
| 0189570 | 7/1990 | Japan | 355/274 |
| 0125665 | 4/1992 | Japan . | |
| 0130831 | 5/1994 | Japan | 355/274 |

*Primary Examiner*—Robert Beatty
*Attorney, Agent, or Firm*—Fitzpatrick, Cella, Harper & Scinto

[57] ABSTRACT

An image forming apparatus includes an image bearing member for bearing an image, a rotatable recording material bearing member for bearing a recording material and conveying the recording material to a transfer station, the image formed on the image bearing member being transferred onto the recording material born on the recording material bearing member at the transfer station, and a cleaning means capable of being contacted with a surface of the recording material bearing member to clean the surface of the recording material bearing member at a cleaning station. When a length (L1) of a recording material born on the recording material bearing member in a rotational direction of the recording material bearing member is greater than a distance (L2) from the transfer station to the cleaning station along the rotational direction of the recording material bearing member, after the image is transferred onto the recording material born on the recording material bearing member, the recording material is conveyed to the transfer station again.

33 Claims, 23 Drawing Sheets

IMAGE FORMING APPARATUS HAVING RECORDING MATERIAL BEARING MEMBER

BACKGROUND OF THE INVENTION

1. Field of the Invention

The present invention relates to an image forming apparatus of electrophotographic type of electrostatic recording type such as a copying machine, a laser beam printer, facsimile and the like.

2. Related Background Art

For example, various full-color image forming apparatuses having an image bearing member (photosensitive drum) of electrophotographic type for forming a toner image, and a transfer material bearing member for bearing a sheet (transfer material) onto which the toner image is transferred have been proposed and put to practical use. An example of such a full-color image forming apparatus is shown in FIG. 7.

In such a full-color image forming apparatus, around a photosensitive drum (image bearing member) 1 rotated in a direction shown by the arrow, there are arranged a corona charger 2, an exposure optical system 3, a developing means 4, a transfer device 5 and a cleaning device 6. Further, a cleaning device (transfer cleaner) 14 for cleaning a transfer drum 5*a* of the transfer device 5 is arranged around the transfer device 5.

The optical system 3 comprises a laser beam exposure device as shown having an original scanning portion and a color decomposing filter and adapted to illuminate a color-decomposed light image or a light image E corresponding to the color-decomposed light image onto the photosensitive drum 1. By successively illuminating the light images color-decomposed by the optical system 3 onto the photosensitive drum 1 negatively and uniformly charged by the charger 2, electrostatic latent images corresponding to different colors are successively formed on the photosensitive drum 1.

The developing means 4 is of rotatable type and comprises four developing devices, i.e., a yellow developing device 4Y, a magenta developing device 4M, a cyan developing device 4C and a black developing device 4K mounted around a rotary shaft 4*b* so that a desired developing device can be brought to a developing station opposed to the photosensitive drum 1, where the latent image formed on the photosensitive drum 1 is developed with toner having resin as a base component to form a toner image. The toner image formed on the photosensitive drum 1 is transferred onto a recording material supplied from a recording material supply cassette 7 to the transfer device 5 at a transfer station where the transfer device 5 is opposed to the photosensitive drum 1.

In this example, the transfer device 5 includes the transfer drum 5*a* as a transfer material bearing member which comprises a cylinder having a peripheral opening and a recording material (transfer material) bearing sheet 5*f* made of dielectric material and covering the peripheral opening. Around the transfer drum 5*a*, there are arranged a transfer charger 5*b*, an absorb charger 5*c*, an absorb roller 5*g*, inner and outer chargers 5*d*, 5*e* and a separation charger 5*h*. These chargers such as the transfer charger 5*b* and the like comprise corona chargers. The absorb roller 5*g* comprises a conductive roller.

The recording material supplied from the recording material supply cassette 7 to the transfer device 5 through a convey system is electrostatically absorbed on the bearing sheet 5*f* of the transfer drum 5*a* by means of the absorb charger 5*c* and the absorb roller (acting as a counter electrode) 5*g* so that the recording material can be conveyed toward the transfer station as the transfer drum 5*a* is rotated. At the transfer station, by applying an electric field to the recording material by means of the transfer charger (corona charger) 5*b* disposed within the transfer drum 5*a*, the toner image formed on the photosensitive drum 1 is transferred onto the recording material. The recording material to which the toner image was transferred is conveyed to the transfer station again by the rotation of the transfer drum 5*a*, where the toner image for a next color formed on the photosensitive drum 1 is transferred onto the same recording material.

After four color toner images are transferred onto the recording material in this way, the electricity is removed from the recording material by the separation charger 5*h* disposed outside the transfer drum 5*a*, and then, the recording material is separated from the bearing sheet 5*f* by a separation means 8. The separated recording material is sent to a fixing device 9, where the toner images are fused and mixed to be fixed to the recording material, thereby forming a permanent full-color image. On the other hand, the residual toner remaining on the photosensitive drum 1 and the bearing sheet 5*f* is removed by the cleaning device 6 and the cleaning device 14, respectively, for preparation for the next image formation.

Incidentally, convey paths for the recording material supplied from the cassette 7 and a recording material supplied by the manual insertion are shown by the broken lines in FIG. 7.

However, in the above-mentioned conventional image forming apparatus, the cleaning of the bearing sheet 5*f* is started during the separation of the recording material from the transfer drum 5*a*, and the cleaning is also started from a point (on the transfer drum 5*a*) where a tip end of the recording material was positioned. Thus, as shown in FIG. 8, if a distance between the transfer station (where the transfer drum 5*a* is opposed to the photosensitive drum 1) and the transfer cleaner 14 L2 along a rotational direction of the transfer drum 5*a* having the bearing sheet 5*f* is smaller than a peripheral distance (recording material peripheral length) L1 on a peripheral surface of the bearing sheet 5*f* of the transfer drum 5*a*, when the transfer cleaner 14 is driven as the point where the tip end of the recording material was positioned reaches the transfer cleaner 14, since the last color toner image is still being transferred onto the recording material, the color deviation of the last color toner image will occur due to the shock.

In order to eliminate such inconvenience, in the past, when the recording material peripheral length L1 is long, after the recording material is separated from the transfer drum, the transfer drum 5*a* is idly rotated by one revolution, thereby cleaning the transfer drum. In this case, however, in a both-face image formation (both-face copy) mode, it is impossible to prevent the deterioration of the image due to the oil contamination on the photosensitive drum. That is to say, in the both-face image formation mode wherein, after four color toner images are transferred onto a front surface (first surface) of the recording material (transfer material) and the toner images are fixed by the fixing device, the recording material is turned up (reversely rotated) to use a back surface (second surface) of the recording material as a front surface and is born on the transfer drum 5*a* in that condition to transfer the toner images onto the second surface, fixing oil adhered from a fixing roller of the fixing device 9 to the first surface of the recording material during the transferring of the toner images onto the first surface is transferred onto and adhered to the bearing sheet 5*f* of the transfer drum 5*a* when the toner images are transferred onto the second surface of the recording material born on the transfer drum. And, the fixing oil adhered to the bearing sheet 5*f* is transferred onto and adhered to the photosensitive drum 1 at the transfer station (where the bearing sheet 5*f* is contacted with the photosensitive drum 1) during the idle rotation of the transfer drum 5*a* (for cleaning) after the recording material on the second surface of which the toner images were transferred is separated from the transfer drum 5*a*.

As a result, when the both-face image formation are continuously effected with respect to a plurality of recording materials, the fixing oil is trapped on the photosensitive drum 1. Consequently, if the further image formation tries to continue, the toner from the developing means will be adhered to a portion on the photosensitive drum which should be kept white due to the viscosity of the fixing oil, thereby causing the fog in the transferred image. Further, during the developing operation, the toner adhered to a portion on the photosensitive drum which should be kept all black is difficult to be separated from the photosensitive drum due to the viscosity of the fixing oil, with the result that the toner is not transferred onto the recording material sufficiently, thereby causing the transferred image thinner. In this way, in the cleaning system wherein the toner is removed from the transfer drum after the recording material is separated from the transfer drum and then the transfer drum is idly rotated by one revolution, since the fixing oil adhered to the recording material during the both-face image formation is transferred onto the photosensitive drum during the idle rotation of the transfer drum to contaminate the photosensitive drum, the image is deteriorated. Thus, this system is not preferable.

Accordingly, in order to prevent the deterioration of the image due to the oil contamination of the photosensitive drum during the both-face image formation, it is necessary to clean the bearing sheet during the rotation of the transfer drum for separating the recording material from the transfer drum. However, as mentioned above, when the length L1 of the recording material is greater than the distance L2 between the transfer station and the cleaner, since the last color toner image is still being transferred onto the recording material, the color deviation of the last toner image cannot be avoided.

SUMMARY OF THE INVENTION

An object of the present invention is to provide an image forming apparatus which can clean a surface of a recording material bearing member without causing deviation of an image.

Another object of the present invention is to provide an image forming apparatus capable of forming images on both surfaces of a recording material.

A further object of the present invention is to provide an image forming apparatus which can prevent fixing oil from adhering to an image bearing member.

A still further object of the present invention is to provide an image forming apparatus wherein, after an image is transferred onto a recording material, the recording material can be conveyed to a transfer station again by a recording material bearing member.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

First Embodiment

Figure 1:
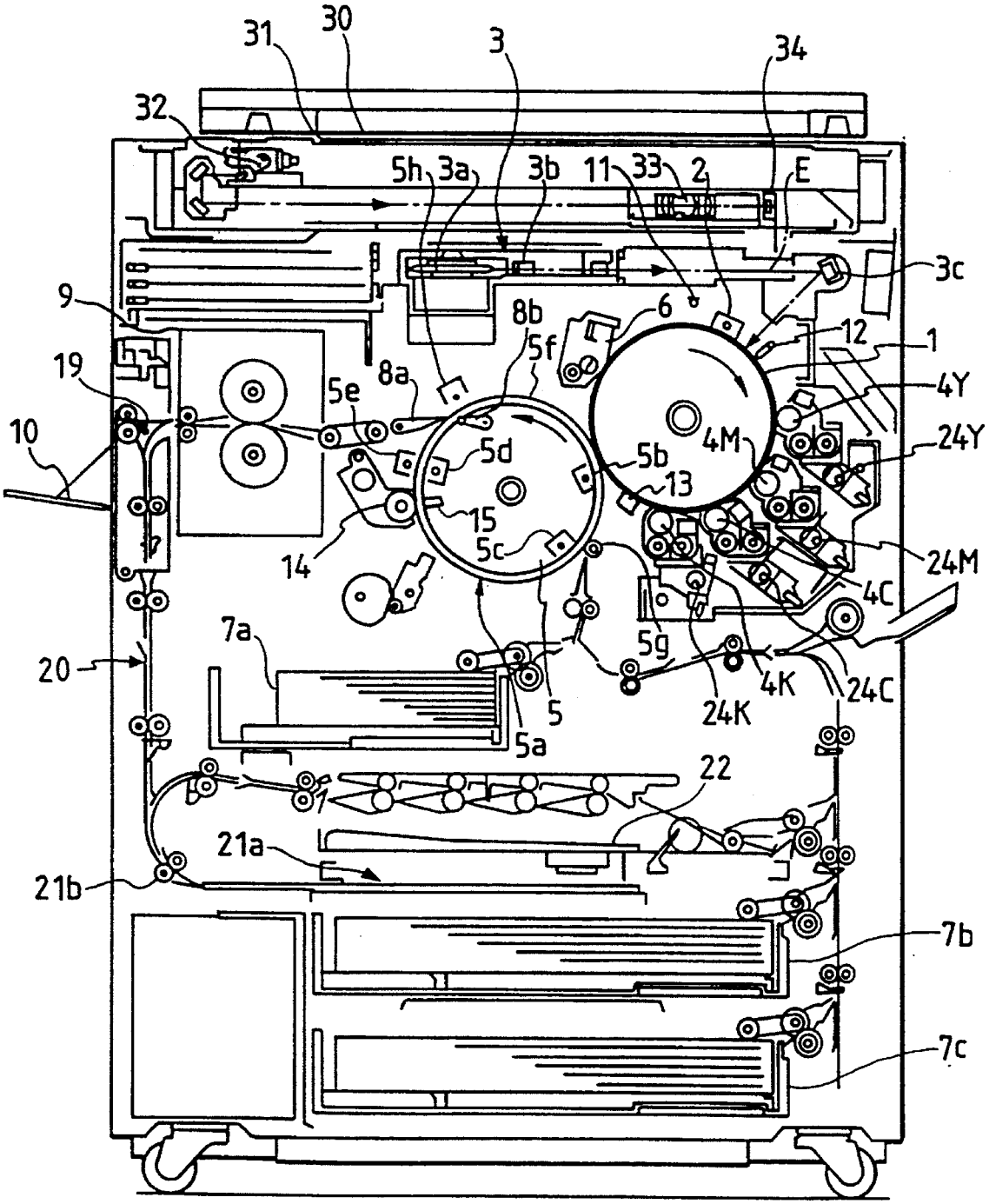
FIG. 1 is an elevational sectional view of an image forming apparatus according to a first embodiment of the present invention.

FIG. 1 is a sectional view of an image forming apparatus according to a first embodiment of the present invention. Since, particularly when the present invention is applied to the both-face image formation in a full-color copying machine, the excellent advantages can be obtained, in the first embodiment, the present invention is applied to such a full-color copying machine.

The color copying machine comprises an upper digital color image reader portion and a lower digital color image printer portion. In the image reader portion, after an original 30 is rested on an original glass support 31, by exposure-scanning a surface of the original by means of an exposure lamp 32, a light image reflected from the original 30 is condensed on a full-color sensor 34 through a lens 33, thereby generating a color-decomposed image signal. The color-decomposed image signal is sent, through an amplification circuit (not shown), to a video treatment unit (not shown), where the signal is processed or treated, and the treated signal is sent to the digital color image printer portion. On the other hand, in the digital color image printer portion, a photosensitive drum (image bearing member) 1 has a photosensitive body comprised of an organic photoconductive body which will be described later and is supported for rotation in a direction shown by the arrow. Around the photosensitive drum 1, there are arranged a pre-exposure lamp 11, a corona charger 2, a laser exposure optical system 3, a potential sensor 12, four developing devices 4*y*, 4*c*, 4*m*, 4Bk containing different color toners, a drum light amount detection means 13, a transfer device 5, and a cleaning device 6.

In the laser exposure optical system 3, the image signal from the reader portion is converted into an image scan exposure light signal by a laser output portion (not shown), and the converted laser light is reflected by a polygon mirror 3*a*. The reflected light is projected onto the photosensitive drum 1 through a lens 3*b* and a mirror 3*c*. When an image is formed in the printer portion, the photosensitive drum 1 is rotated in the direction and the electricity on the photosensitive drum is removed by the pre-exposure lamp 11. Then, the photosensitive drum 1 is uniformly charged negatively by the charger 2, and a color-decomposed light image E for each color is illuminated on the photosensitive drum, thereby forming a latent image on the drum.

Then, a selected developing device is operated to reversely develop the latent image formed on the photosensitive drum 1, thereby forming a toner image on the photosensitive drum 1 with negative powder toner including resin as a main component. The developing devices 4*y*, 4*c*, 4*m*, 4Bk are selectively brought toward the photosensitive drum 1 by means of respective eccentric cams 24*y*, 24*c*, 24*m*, 24Bk to develop the latent image.

Thereafter, the toner image formed on the photosensitive drum 1 is transferred onto a recording material supplied from a recording material cassette 7*a*, 7*b* or 7*c* through a convey system and the transfer device 5 to a position where the recording material is opposed to the photosensitive drum 1. The transfer device 5 comprises a transfer drum 5*a*, a transfer charger 5*b*, a pair of absorb charger 5*c* and absorb roller 5*g* for electrostatically absorbing the recording material, an inner charger 5*d*, an outer charger 5*e* and a separation charger 5*h*. Further, a peripheral opening of the rotatable transfer drum 5*a* is covered by a cylindrical recording material bearing sheet (transfer sheet) 5*f* for bearing the recording material. The recording material bearing sheet 5*f* is formed from dielectric polycarbonate film and the like.

On the other hand, the recording material is supplied from the cassette 7 to the transfer device 5 and is electrostatically absorbed on the transfer sheet 5*f* by the absorb charger 5*c* and the opposed absorb roller 5*g*. The toner images having different colors are successively transferred onto the recording material by the transfer charger 5*b* in synchronous with the above-mentioned color-decomposed toner images.

As shown in FIG. 1, since the single image having one color is formed in the single image formation process, the color decomposing processes are repeated by several times corresponding to the number of colors of toner (i.e., by four times corresponding to yellow (Y), magenta (M) , cyan (C) and black (B)). Similarly, in synchronous with the color decomposing processes, the latent image formation, development and transferring are repeated for each color, thereby forming a full-color image. In the full-color image formation, after four color toner images were transferred to the recording material in this way, the recording material is separated from the transfer drum 5*a* under the action of a separation pawl 8*a*, a separation push-up roller 8*b* and the separation charger 5*h*, and the separated recording material is sent to a heat roller fixing device 9, where the full-color image is fixed to the recording material by fusing and mixing the toner images. Then, the recording material is discharged onto a tray 10. In this way, one full-color copying operation is completed.

On the other hand, after the transferring operation, the residual toner remaining on the photosensitive drum 1 is removed by the cleaning device 6 for preparation for the next image formation.

When the images are formed on both surfaces of the recording material, immediately after the recording material is discharged from the fixing device 9, a convey path switching guide 19 is driven so that the recording material is introduced into a reverse rotation path 21*a* through a longitudinal convey path 20. Then, reverse rotation rollers 21*b* are rotated reversely to return the recording material from the reverse rotation path 21*a* in an opposite direction with a trailing end of the recording material becoming an forward end, thereby temporarily storing the recording material on an intermediate tray 22. Then, the recording material is re-supplied to the transfer device 5 to absorb the recording material on the transfer sheet 5*f* with the imaged surface being contacted with the transfer sheet 5*f*, so that, during the next image formation, the image is formed on the other surface of the recording material.

In order to remove the toner and fixing oil adhered to the recording material bearing sheet 5*f* of the transfer drum 5*a*, a transfer cleaner 14 is arranged at a downstream side of the transfer station in a rotational direction of the transfer drum 5*a*. A back-up brush 15 disposed within the transfer drum is opposed to the transfer cleaner 14 with the interposition of the bearing sheet 5*f*.

Figure 2:
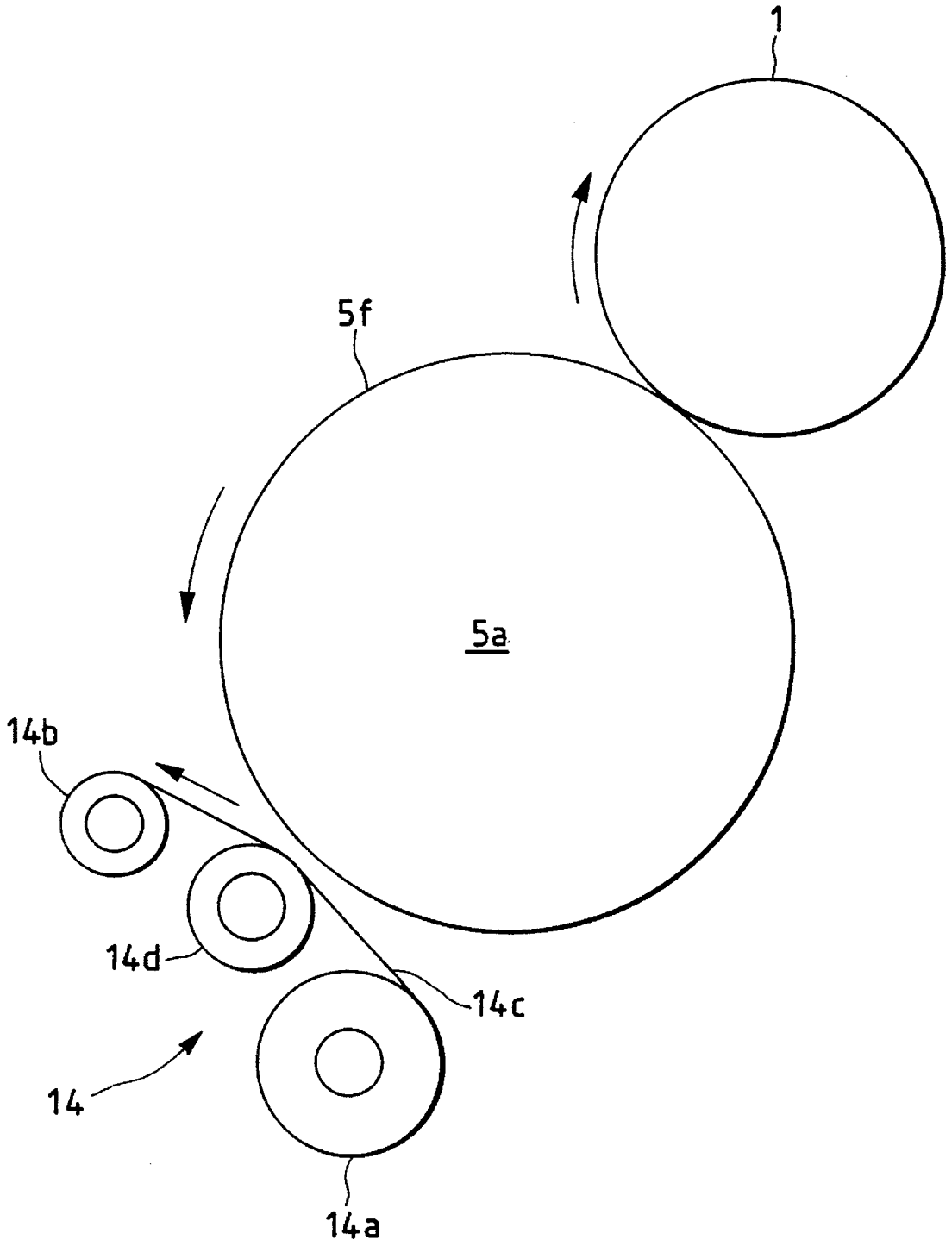
FIG. 2 is a schematic view for showing a transfer cleaner for cleaning a recording material bearing sheet of a transfer drum of the image forming apparatus of FIG. 1.

In the illustrated embodiment, since the transfer cleaner 14 also acts as an oil removing member, as shown in FIG. 2, the transfer cleaner comprises a web 14*c* unwound from one roller 14*a* and wound around the other roller 14*b*. The web 14*c* is urged against the transfer sheet 5*f* by an intermediate urging roller 14*d* while sliding on the transfer sheet 5*f*, thereby removing the toner and oil from the transfer sheet 5*f*. Incidentally, the cleaner 14 is kept to be separated from the bearing sheet 5*f* while the recording material having the image thereon is passing through a cleaning station. In the illustrated embodiment, the web 14*c* is formed from non-woven fabric as follows:

Material of web: non-woven fabric made of synthetic fibers comprised of nylon and polyester Diameter of fiber: average diameter is 4 μm, and a percentage of fibers having diameter of 10 μm or less is 90%

Density of non-woven fabric: 0.17 g/cm$^3$

Average distance between fibers: 2.5 μm

Thickness of non-woven fabric: 500 μm.

By using the web 14*c* formed from such a non-woven fabric, the oil could be removed from the transfer sheet 5*f* substantially completely. Further, the material of fibers forming the non-woven fabric may be polypropyrene, layon, acryl, nylon, polyester, vinylon or the combination thereof, as well as the above-mentioned material. It was found that these materials have substantially no technical difference.

The fiber density of the non-woven fabric is preferably in a range of 0.005–0.80 g/cm$^3$. Particularly, it was found that the non-woven fabric having the fiber density of 0.1–0.5 g/cm$^3$ provides excellent oil removing ability. Incidentally, it was found that the use of woven fabric formed by appropriately weaving the above fibers is undesirable because oil stripes are created in the woven direction of the fabric due to the incomplete removal of oil and because the range of the setting condition of such fabric for use as an oil cleaning member is very narrow.

Further, in order to improve oil absorbing ability, the non-woven fabric may be formed from two layers, i.e., an oil removing layer and an oil absorbing layer. In addition, the transfer cleaner is not limited to the web but may be a roller, which achieves the same technical effect as the web. When the transfer cleaner is formed from the roller, the entire transfer cleaner can be made more compact in comparison with the transfer cleaner of web type.

Figures 3A, 3B, 3C:
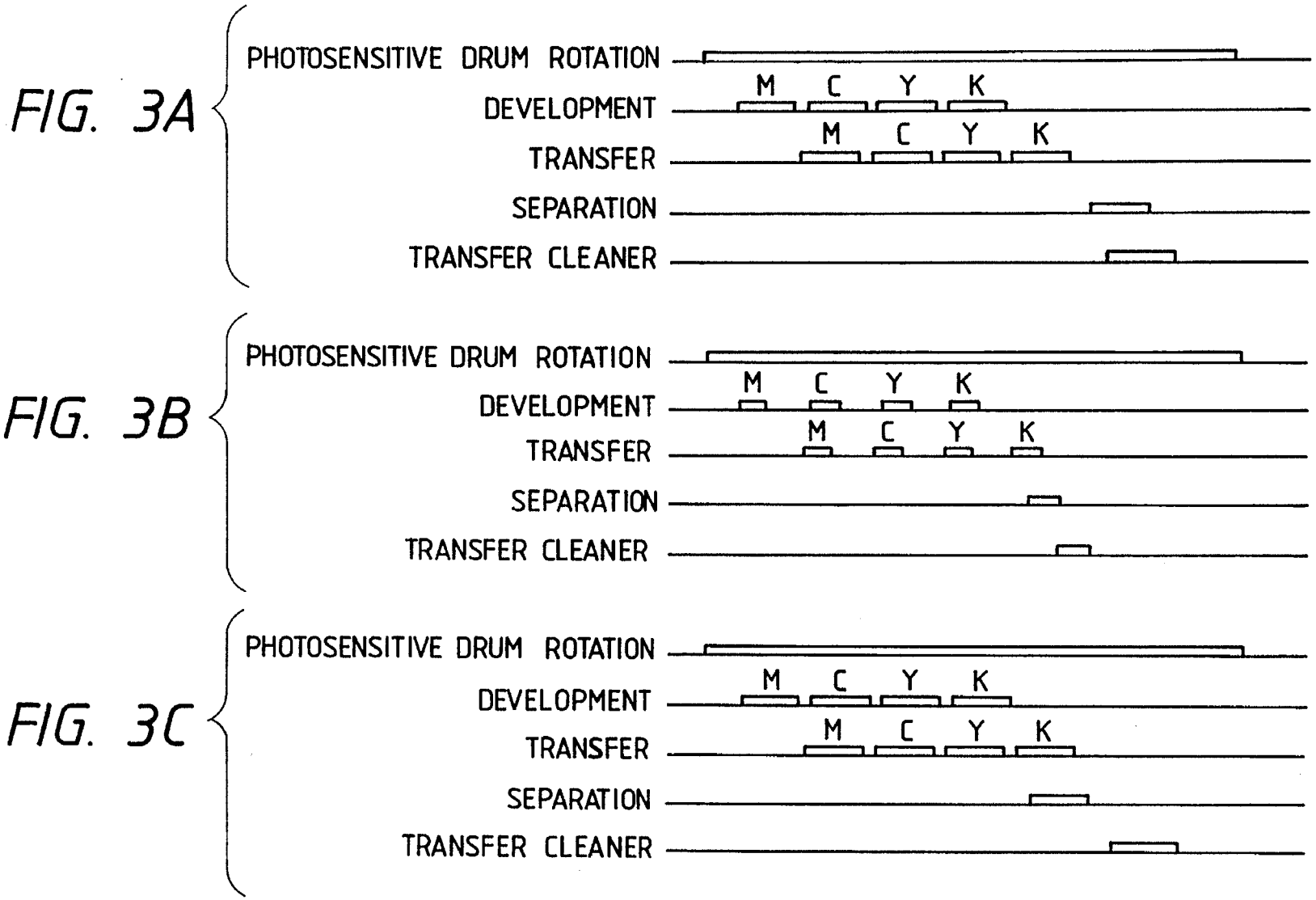
FIGS. 3A to 3C are views showing image forming sequence to which the cleaning control in the image forming apparatus of FIG. 1 is added.

FIGS. 3A to 3C show image formation sequences to which the cleaning control according to the illustrated embodiment is added. This is a sequence for forming an image on the second surface of the recording material having the fixed image on its first surface. FIG. 3A shows the sequence when a circumferential distance (length) of the recording material P along the peripheral surface of the transfer sheet 5*f* is greater than a distance (transfer station/cleaner station distance) L2 from the transfer station (where the transfer drum 5*a* is opposed to the photosensitive drum 1) to the transfer cleaner 14 along the rotational direction of the transfer drum 5*a* having the transfer sheet 5*f*, FIG. 3B shows the sequence when the length L1 of the recording material is smaller than the transfer station/cleaner station distance L2, and FIG. 3C shows a comparison example when the length L1 of the recording material is greater than the transfer station/cleaner station distance L2.

Incidentally, a diameter of the transfer drum 5*a* was 180 mm, and the transfer station/cleaner station distance L2 was 270 mm.

In FIG. 3A, during the rotation of the transfer drum 5*a* while the last color toner image (black toner image (K)) is being transferred, the transfer drum continues to be rotated without separating the recording material from the transfer drum. Thereafter, immediately after the recording material passes through the transfer station again, the recording material is separated from the transfer drum. During the rotation of the transfer drum while the recording material being separated from the transfer drum, the cleaning operation is effected by the transfer cleaner 14, thereby cleaning the transfer sheet 5*f*. The cleaning operation is effected by contacting the cleaner 14 with the transfer sheet 5*f*. That is to say, since the transfer sheet 5*f* is cleaned after the last color toner image was transferred onto the recording material, the shock due to the cleaning operation does not affect a bad influence upon the transferring of the last color toner image, with the result that the transfer sheet 5*f* can be cleaned without color deviation.

In FIG. 3B, during the rotation of the transfer drum 5*a* while the last color toner image is being transferred, the recording material is separated from the transfer drum and the cleaning operation for the transfer sheet 5*f* is effected. That is to say, after the transferring operation is finished, the recording material is not conveyed to the transfer station again. To the contrary, in FIG. 3C, during the rotation of the transfer drum 5*a* while the last color toner image is being transferred, the recording material is separated from the transfer drum, but the cleaning operation for the transfer sheet 5*f* is not effected. And, the cleaning operation is effected during the next rotation of the transfer drum.

As mentioned above, by cleaning the transfer sheet 5*f* by controlling the transfer cleaner 14 under the sequence shown in FIG. 3A, even when the circumferential length L1 of the recording material is greater than the transfer station/cleaner station distance L2, the transfer sheet can be cleaned without the color deviation. To the contrary, in FIG. 3C, in order to prevent the color deviation, an area of the transfer sheet 5*f* which was contacted with the recording material before the separation of the recording material reaches the transfer station before that area is cleaned by the transfer cleaner 14. Accordingly, when the image is formed on the second surface of the recording material, the fixing oil is transferred from the transfer sheet 5*f* to the photosensitive drum.

Second Embodiment

Figure 4:
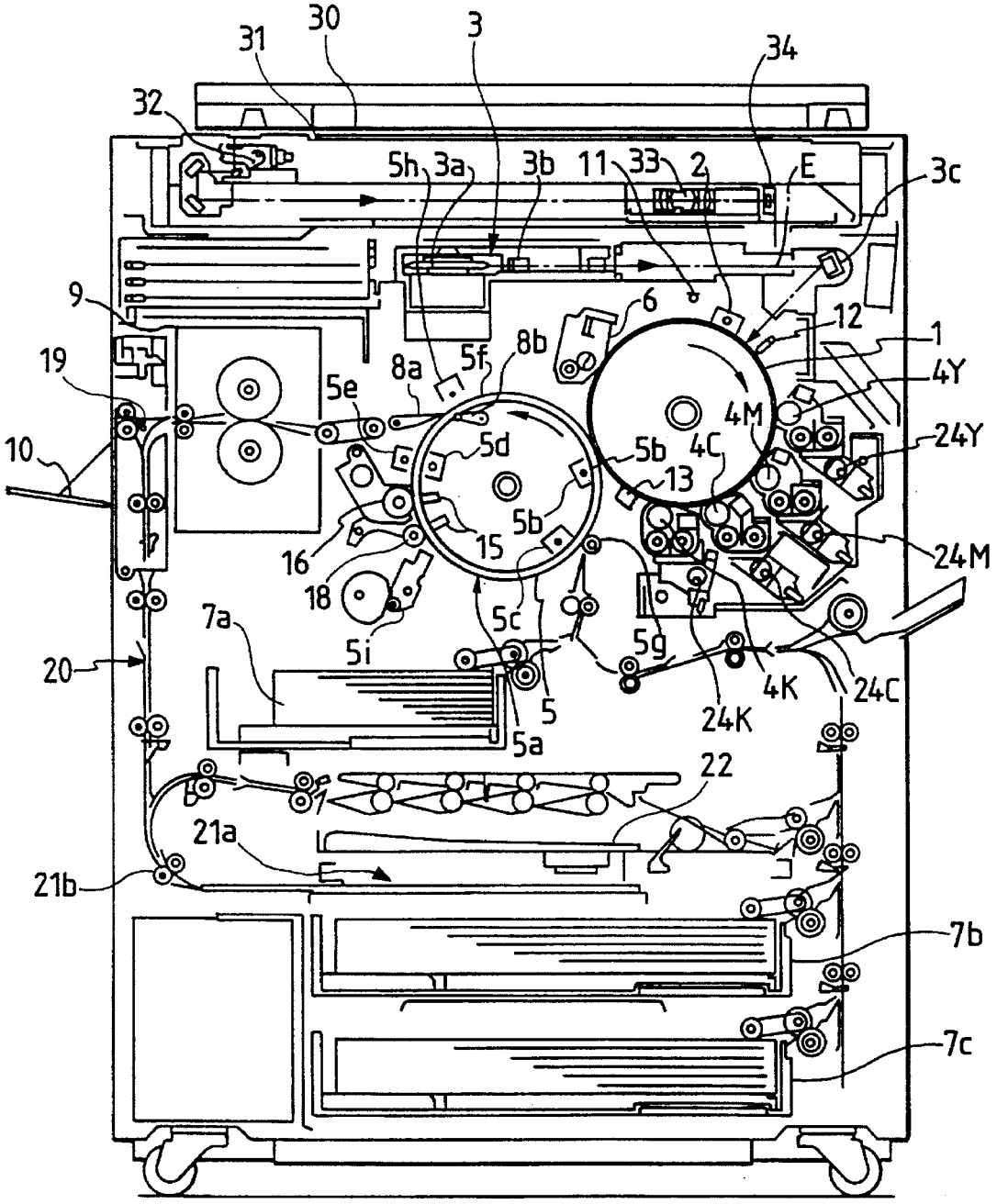
FIG. 4 is an elevational sectional view of an image forming apparatus according to another embodiment of the present invention.

FIG. 4 is a sectional view of an image forming apparatus according to another embodiment of the present invention. In the above-mentioned first embodiment, the single transfer cleaner 14 of web type was used as the transfer cleaner to clean the transfer sheet 5*f*. However, since the cleaner of web type or roller type is slidingly contacted with the transfer sheet strongly to shorten the service life of the transfer sheet, it is not preferable that both the toner and the oil are removed by the single cleaner of web type or roller type. Although the sliding cleaning is required for removing the oil, when the toner alone is removed, the relatively weak cleaning (for example, by using a fur brush) can be used. Incidentally, in FIG. 4, the same elements as those shown in FIG. 1 are designated by the same reference numerals and explanation thereof will be omitted.

In the second embodiment, as shown in FIG. 4, a transfer cleaner 16 of fur brush type for removing the toner and a transfer cleaner 18 of web type for removing the oil are provided. Back-up brushes 15 are opposed to the cleaners 16, 18 with the interposition of the transfer sheet 5*f*. The transfer cleaner 18 of web type for removing the oil has substantially the same construction as that used in the first embodiment. In place of the transfer cleaner of web type, a transfer cleaner of roller type may be used for removing the oil. Since the transfer cleaner 18 of web type for removing the oil is slidingly contacted with the surface of the transfer sheet 5*f*, the cleaner 18 is preferably driven only in the both-face image formation regarding the recording material. Further, in order to prevent the toner clogging of the cleaner 18, the transfer cleaner 18 of web type is preferably used together with the transfer cleaner 16 of fur brush type for removing the toner.

In this embodiment, the transfer station/cleaner station distance L2 is selected as a distance between the transfer station (where the transfer sheet 5*f* is opposed to the photosensitive drum 1) and the transfer cleaner 16 for removing the toner. The image formation sequence according to this embodiment is the same as that of the first embodiment, and, thus, explanation thereof will be omitted. When two transfer cleaners are used in this way, the present invention is also effective. And, even when the circumferential length L1 of the recording material is greater than the transfer station/cleaner station distance L2, the transfer sheet 5*f* can be cleaned without the color deviation.

Third Embodiment

Figure 5:
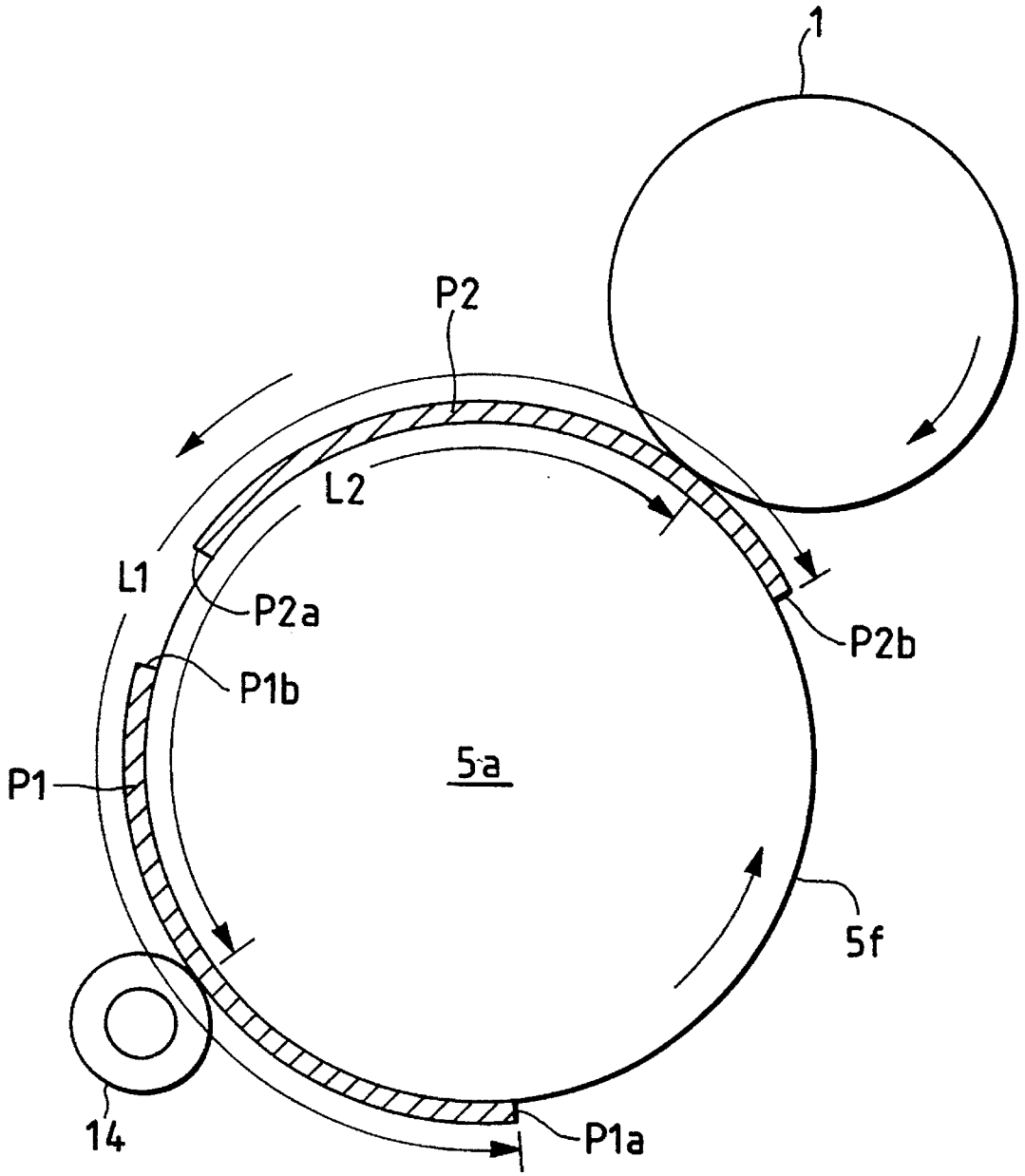
FIG. 5 is an explanatory view for explaining a condition that two transfer materials are born on a transfer drum of the image forming apparatus of FIG. 4.

When the peripheral length of the transfer drum 5*a* is greater than twice of the length of the recording material, in order to increase through-put (process amount) in the continuous image formation for continuously forming the images on a plurality of recording materials in response to an image formation start signal inputted to the apparatus, two or more recording materials are born on the transfer drum to form the images on the recording materials. The present invention can also be applied in this case. In this case, the circumferential length L1 of the recording material is assumed as a distance between a tip end of a first recording material and a trailing end of a last original (the first to last originals are simultaneously born on the transfer drum 5*a*). FIG. 5 is an explanatory view for explaining such a condition. In FIG. 5, two recording materials P1, P2 are born on the transfer drum 5*a*. In this case, the circumferential length L1 of the recording material corresponds to a distance between the tip end P1*a* of the first recording material P1 and the trailing end P2*b* of the second recording material P2 including a material-to-material distance between a trailing end P1*b* of the first recording material P1 and a tip end P2*a* of the second recording material P2.

Figure 6:
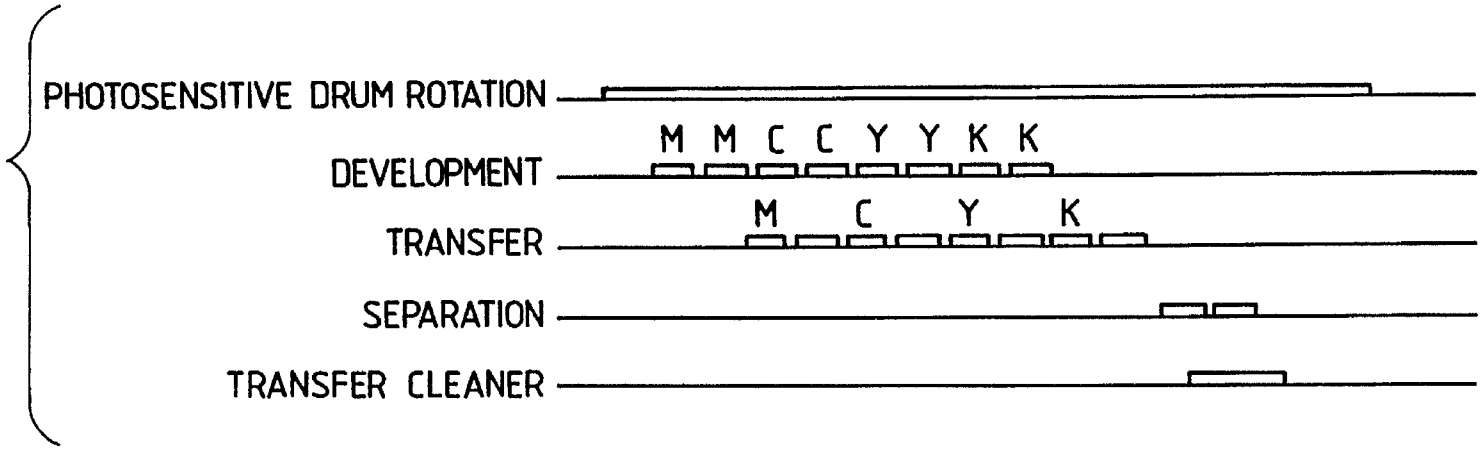
FIG. 6 is a view showing image forming sequence to which the cleaning control in the image forming apparatus of FIG. 4 is added.
Figure 7:
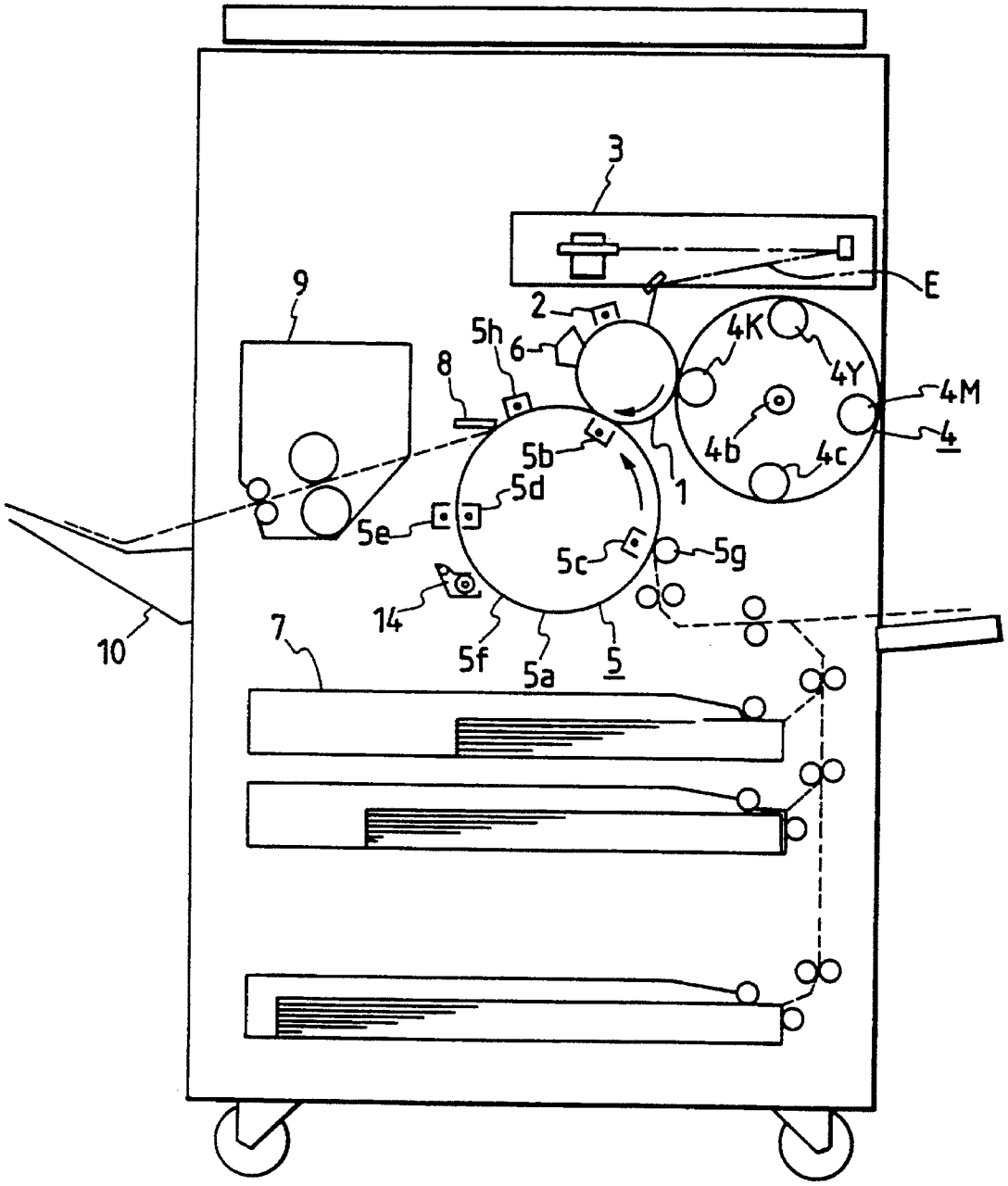
FIG. 7 (PRIOR ART)
FIG. 7 is a schematic elevational sectional view showing an example of a conventional image forming apparatus.
Figure 8:
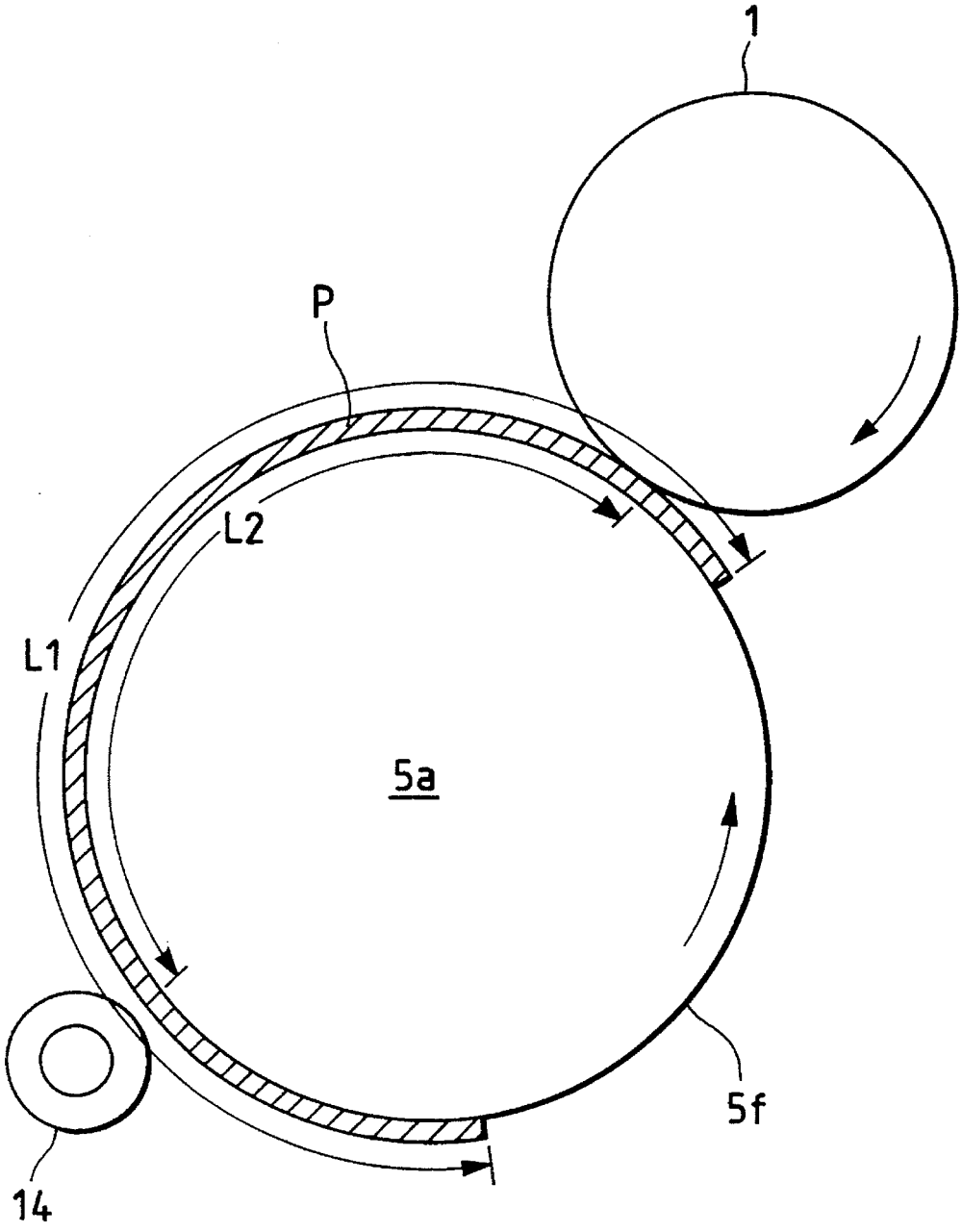
FIG. 8 is an explanatory view for explaining a relation between a circumferential length L1 of a transfer material born on a transfer drum of an image forming apparatus and a distance L2 between a transfer station and a cleaning member.

FIG. 6 shows an image formation sequence to which the cleaning control according to the third embodiment is added. When the circumferential length L1 of the recording material is greater than the transfer station/cleaner station L2, during the rotation of the transfer drum while the last color image is being transferred, both the recording material P1 and the recording material P2 are not separated from the transfer drum 5*a* and the transfer drum continues to rotate. Thereafter, immediately after each recording material passes through the transfer station again, the recording materials are successively separated from the transfer drum. During the rotation of the transfer drum while the recording materials are being separated from the transfer drum, the cleaning operation is effected by the transfer cleaner 14. In case of the both-face image formation, the sequence is the same as that in the first and second embodiments.

As mentioned above, by adopting the sequence regarding the cleaner as shown in FIG. 6, even when two recording materials are simultaneously born on the transfer drum and the circumferential length L1 of the recording material is greater than the transfer station/cleaner station L2, the transfer sheet can be cleaned while preventing the color deviation.

In the conventional image forming apparatuses of electrophotographic type, a heat roller fixing device has been widely used as a fixing device for fixing the toner images transferred to the recording material. The rollers used in the heat roller fixing device each has an outer coating layer made of material having good mold releasing ability and excellent heat-resistance and anti-wear ability such as fluororesin, silicone rubber or the like. As is in the color copying machine of electrophotographic type, particularly when the image quality is important, silicone rubber is generally used as the outer coating layer. The silicone rubber has the mold releasing ability less than that of fluororesin. However, when the silicone oil is coated on the rollers as mold releasing agent, the mold releasing ability superior to that of fluororesin can be obtained.

However, in the image forming apparatuses using the above-mentioned conventional fixing device, in a both-face copy image formation for forming the images on both surfaces of the recording material, since the toner image formed on the photosensitive drum is transferred onto the recording material to which the silicone oil (referred to as "fixing oil" hereinafter) was adhered in the fixing operation regarding the first surface of the recording material, the fixing oil on the recording material is transferred onto the photosensitive drum, thereby causing fault of image. Since the fixing oil adhered to the first imaged surface of the recording material is not transferred to the photosensitive drum, the faulty image is transferred onto the surface of the transfer drum during the second surface transferring operation, and then is transferred onto the photosensitive drum due to the direct contact between the transfer drum and the photosensitive drum. As a result, there arise unevenness in image due to uneven latent image potential, fog due to adhesion of toner to the oil, and/or poor cleaning, thereby deteriorating the image.

Figure 22:
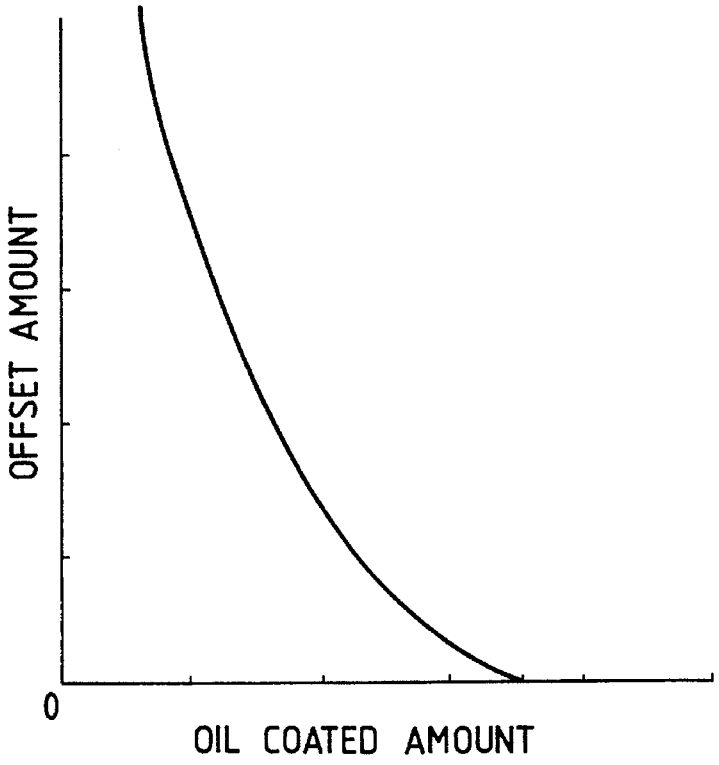
FIG. 22 is a graph showing a relation between an oil coated amount and an offset amount.

By the way, there is a relation between the offset amount of the fixing roller and the oil coated amount, as shown in FIG. 22. In FIG. 22, the abscissa indicates the oil coated amount, and the ordinate indicates the offset amount. The oil coated amount represents the oil coated amount per one recording material of A4 size, and the offset amount is represented by reflection density of offset toner obtained when a given number of recording materials to which a given amount of toner was transferred are fixed. As apparent from the graph shown in FIG. 22, the offset ability is firstly substantially in proportion to the oil coated amount. That is to say, the greater the oil coated amount the higher the offset ability. However, when the oil coated amount of the fixing oil reaches a predetermined value, the improvement of the offset ability of the fixing roller is saturated. Further, by reducing the oil coated amount, the degree of the fault of image can be reduced. However, if the oil coated amount of the fixing oil to the fixing roller is reduced until the fault of image is eliminated, the offset ability is not improved, thereby generating the offset for a short time.

On the other hand, in the fixing process of the image forming apparatus of electrophotographic type, i.e., in the process for mixing and coloring the four color toners, when the images are fixed to various recording materials under the same condition, since the heat capacity is varied depending upon the kind of the recording material, the fixing ability, coloring ability and lusting ability are changed greatly, thereby not ensuring the pictorial reproduction. For example, the optimum fixing condition greatly differs between a recording material of 80 g/m$^2$, a recording material of 157 g/m$^2$ and OHP sheet.

Thus, the fixing condition is varied by automatically discriminating the kind of the recording material or by designating the kind of the recording material by an operator. The fixing condition includes setting temperature, fixing nip, pressure, fixing speed or the like. However, it is common that the fixing speed is varied to obtain the fixing time suitable to the selected recording material in a view point of the response of the apparatus and cost.

Figure 23:
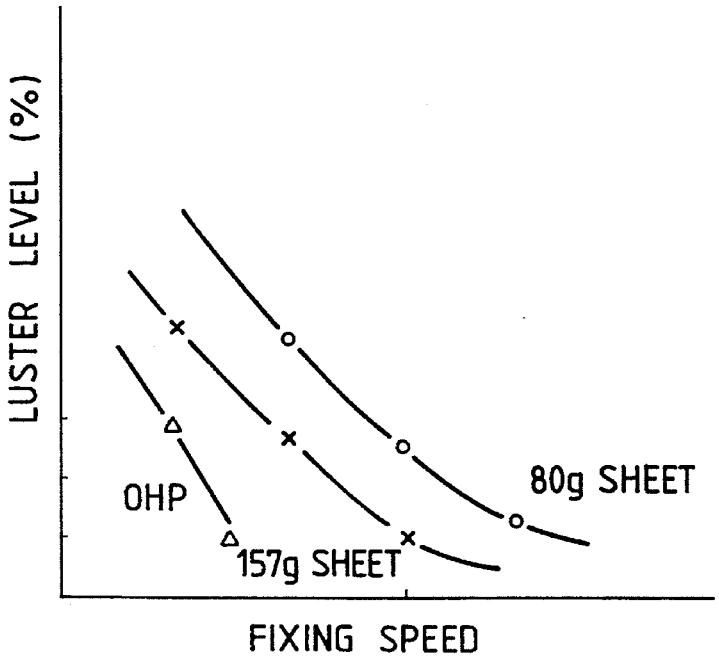
FIG. 23 is a graph showing a relation between a fixing speed and a luster level.

FIG. 23 is a graph showing a relation between the fixing speed and the luster level representative of the fixing ability, depending upon the kinds of the recording materials. According to this graph, it is found that the luster level can be kept constant by compensating the difference in heat capacity due to the difference in kind of recording material by the fixing speed. On the other hand, it is desirable that the image forming speed regarding the recording material is kept constant to optimize the image quality, to optimize the transferring efficiency and to increase the copying speed.

A problem caused when the fixing speed varied depending upon the kind of the recording material is that, after the toner image was transferred onto the recording material, when the toner image is fixed in the fixing process, the conveying speed for the recording material is changed, with the result that the recording material is loosened, thereby distorting the image. In order to solve this problem, it is necessary that there is provided an adequate distance between the transfer process (separation station for the recording material) and the fixing process, i.e., a distance corresponding to a maximum length of an available recording material.

However, if the distance between the transfer process and the fixing process is increased, since a discharge path for discharging the recording material is also lengthened, the first copy time (FCOT) is increased and the entire apparatus becomes bulky.

Figure 24:
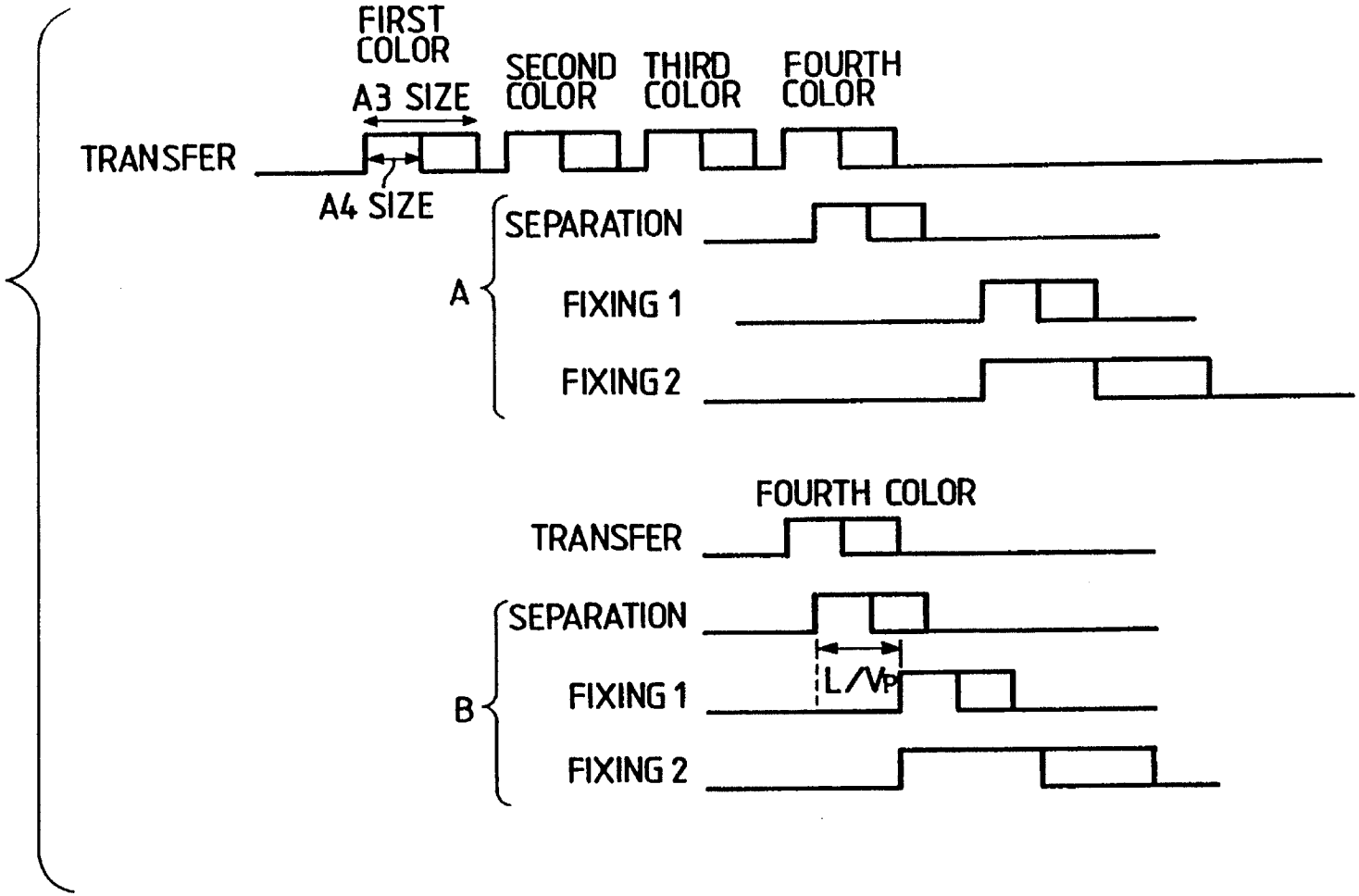
FIG. 24 (PRIOR ART)
FIG. 24 is a copy sequence chart of a conventional image forming apparatus.

FIG. 24 shows sequences of transfer process, separation process and fixing process in the conventional image forming apparatus. As shown in A of FIG. 24, since a distance L between-the separation station and the fixing device is greater than the maximum length of the recording material, the recording material is not subjected to the separating operation and the fixing operation simultaneously. With this arrangement, even when the fixing speed Vp is decreased, so long as the time period till the next fixing operation (material-to-material distance) is selected adequately, there is no problem.

However, as shown in B of FIG. 24, when the distance L between the separation station and the fixing device is short so that the length of the recording material becomes greater than the distance L, the recording material is subjected to the separating operation and the fixing operation simultaneously. With this arrangement, if the fixing speed Vp is decreased, the recording material is loosened, thereby distorting the image.

Accordingly, it is desirable that the image forming apparatus has the following two modes in order to prevent the distortion of the image due to the change in the fixing speed, not to reduce the oil coated amount to the fixing roller and to prevent the inconvenience in the both-face image formation regarding the recording material, even when the distance between the separation station and the fixing device is smaller than the maximum length of the recording material. That is to say, the apparatus has a first mode wherein, after the transferring operation, the recording material is separated from the recording material bearing member without conveying the recording material to the transfer station again, and a second mode wherein, after the transferring operation, the recording material is conveyed to the transfer station again and then is separated from the recording material bearing member. Now, an example of the image forming apparatus having such two modes will be explained.

Preferably, the fixing device comprises a pair of elastic members by which the recording material having the non-fixed toner image thereon is pinched so that the toner image is fixed to the recording material with heat and pressure. The fixing device is associated with an oil removing member for removing the fixing oil from the recording material bearing member and an indication means for indicating the fact that the image formation is to be effected regarding the second surface of the recording material. In response to an output from the indication means, the second mode is carried out, and, after the recording material to which the toner image was transferred is separated from the recording material bearing member, the oil removing member is driven to remove the fixing oil from the recording material bearing member.

Preferably, the recording material conveying speed of the recording material bearing member and the recording material conveying speed of the fixing device are variable, so that, when the recording material conveying speed of the fixing device different from the image forming speed is selected in response to information regarding the recording material, the second mode is carried out, and, after the toner image is transferred onto the recording material, the recording material conveying speed of the recording material bearing member is made equal to the recording material conveying speed of the fixing device.

Fourth Embodiment

Next, a fourth embodiment of the present invention will be explained with reference to FIG. 4.

In this embodiment, in order to remove the oil adhered to the transfer sheet 5*f* of the transfer drum 5*a*, the cleaning operation is effected by an oil removing roller 18 and a back-up brush 15 opposed to the oil removing roller 18 with the interposition of the transfer sheet 5*f*. Further, a fur brush 16 is provided for removing the toner adhered to the transfer sheet 5*f*. Such cleaning operation is effected before or after the image formation, and, whenever the sheet jam occurs, the cleaning operation is effected.

Further, an eccentric cam 25 is operated at desired timing to drive a cam follower 5*i* integrally formed with the transfer drum 5*a*, thereby adjusting a gap between the transfer sheet 5*f* and the photosensitive drum 1. For example, in a stand-by condition or in a power source OFF condition, the transfer drum can be separated from the photosensitive drum.

Figure 9:
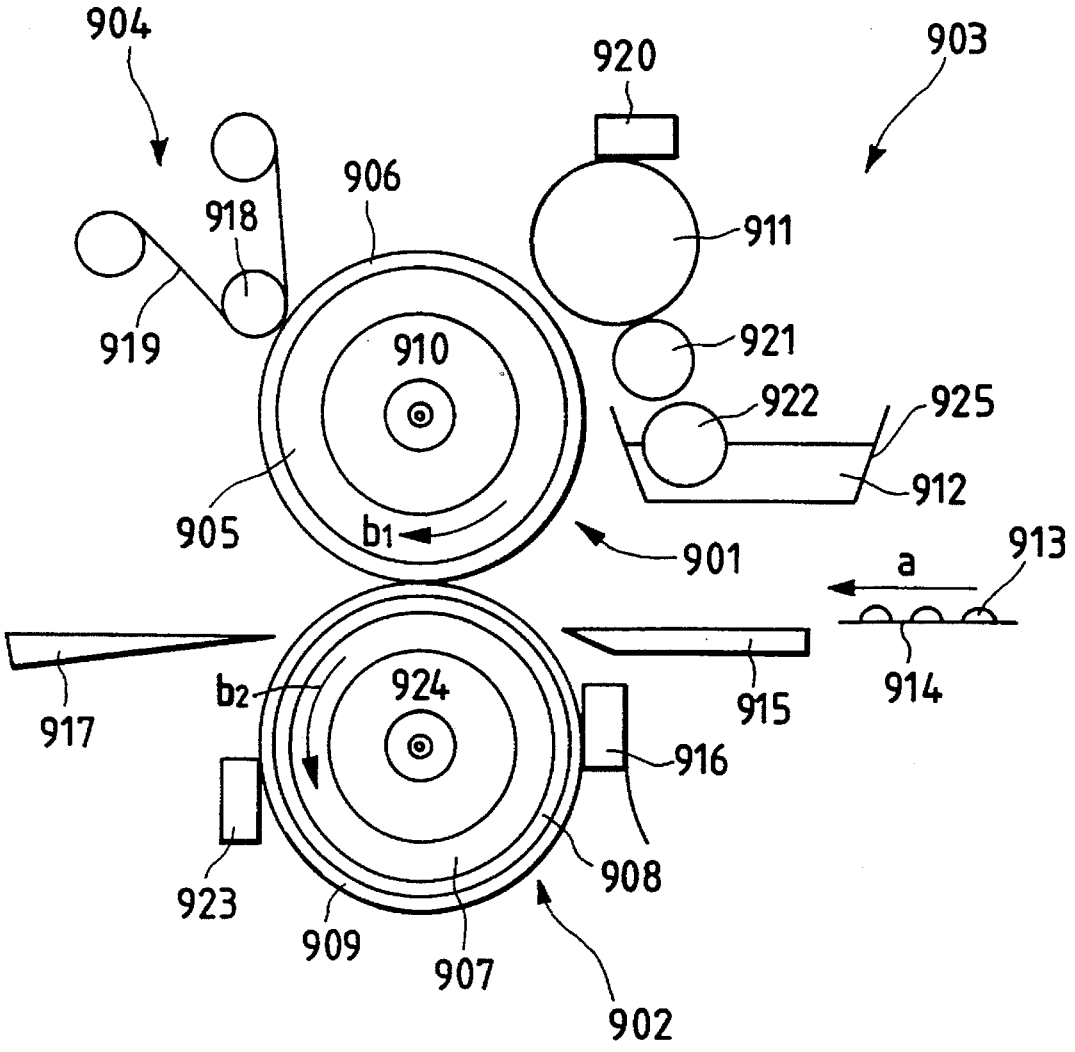
FIG. 9 is a sectional view of a fixing device of the image forming apparatus of FIG. 4.

FIG. 9 shows the fixing device 9 in detail.

In FIG. 9, the fixing device 9 comprises a fixing roller 901, and a pressure roller 902 urged against the fixing foller. The fixing roller 901 comprises a cylindrical core 905 made of aluminium, and an outer layer 906 coated on the core. The outer layer is made of, for example, addition silicone rubber comprised of straight-chain polydimethyl siloxane closed by vinyl end group of 20000–200000 molecular weight as disclosed in the Japanese Patent Application Laid-open No. 61-144675, which silicone rubber provides good mold releasing ability. Further, recently, the use of addition silicone rubber obtained by curing polysiloxane compound comprised of straight-chain polydimethyl siloxane and range-shaped organo siloxane including 4-functional group and/or 3-functional group and having 2 or more vinyl group as constitutional unit has been proposed.

The pressure roller 902 comprises a cylindrical core 907 made of aluminium, an intermediate layer 908 having a predetermined thickness and made of HTV silicone rubber, and an outer resin coating 909. Further, halogen heaters (heat sources) 910, 924 are disposed within the fixing roller 901 and the pressure roller 902, respectively, and the energization of the halogen heaters 910, 924 is controlled by a thermistor 916. With this arrangement, the temperature of the fixing roller 901 and the pressure roller 902 are maintained to the temperature (for example, 170° C.) by which the non-fixed toner image 913 on the recording material 914 can be fixed to the recording material 914. The fixing roller 901 and the pressure roller 902 are rotated in directions shown by the arrows b1, b2, respectively, by a drive source (not shown).

Further, a mold releasing agent coating device 903 for improving the mold releasing ability of toner from the fixing roller 901 is arranged adjacent to the fixing roller 901. The mold releasing agent coating device 903 includes an oil tank 925 containing the fixing oil 912, a first pumping roller 922 immersed into the fixing oil 912, a second pumping roller 921 contacted with the first pumping roller 922, and a coating roller 911 for coating the fixing oil supplied to the second pumping roller 921 on the fixing roller 901. Further, a blade 920 for controlling the coated amount of the fixing oil to be coated on the fixing roller 901 is abutted against the coating roller 911.

In the mold releasing agent coating device constructed as mentioned above, the fixing oil 912 in the oil tank 925 is supplied to the coating roller 911 via the first and second pumping rollers 922, 921, and the coated amount of the fixing oil is adjusted by the blade 920. In this way, the fixing oil is coated on the fixing roller 901. Incidentally, the oil coated amount is about 0.1 gram per recording material of A4 size.

Further, a cleaning device 904 for cleaning the toner offset on the surface of the fixing roller 901 is arranged in an opposed relation to the mold releasing agent coating device 903 with the interposition of the fixing roller 901. The cleaning device 904 comprises a non-woven fabric 919 for cleaning the surface of the fixing roller 901, and an urging roller 981 for urging the non-woven fabric against the fixing roller 901. Further, a cleaner 923 for cleaning the toner offset on the pressure roller 902 is contacted with the pressure roller 902.

In the fixing device 9 constructed as mentioned above, the recording material 914 having the non-fixed toner image 913 thereon is conveyed in a direction shown by the arrow a by a convey device (not shown) and is guided by an inlet guide 915. Then, the recording material is passed through between the fixing roller 901 and the pressure roller 902 (rotated in the directions shown by the arrows b1, b2) with the toner image 913 being contacted with the fixing roller 901. While the recording material is being passed between the rollers, by the pressure provided by the fixing roller 901 and the pressure roller 902 and the heat (the temperature of which is controlled to a predetermined value) supplied from the halogen heater 910 via the fixing roller 901, the non-fixed toner image 913 on the recording material 914 is fixed onto the recording material 914. After the fixing operation, the recording material 914 is discharged out of the image forming apparatus through an outlet guide 917.

The fixing oil used for improving the mold releasing ability is adhered to the recording material to which the toner was fixed. Particularly, the fixing oil is not absorbed in the imaged surface of the recording material and is trapped on the imaged surface.

By the way, the fixing oil (not absorbed and) trapped on the recording material is transferred onto the surface of the transfer sheet 5*f* of the transfer drum 5*a* during the both-face image formation. Thus, the oil removing roller 18 for removing the transferred fixing oil is provided in association with the transfer device 5. By the oil removing roller, the fixing oil adhered to the transfer sheet 5*f* is scraped and absorbed. The oil removing roller 18 may be of roller type or web type made of material suitable for scraping and absorbing the fixing oil. The present invention is not limited to such construction of the oil removing roller.

Next, a both-face copying operation for the color image in the image forming apparatus constructed as mentioned above will be explained. Particularly, the timing for removing the fixing oil from the recording material will be described.

The fundamental consideration as to the image formation sequence is that:

(1) in order to prevent the fixing oil from adhering to the photosensitive drum, the oil removing roller is driven before the transfer sheet to which the fixing oil was transferred from the first surface of the recording material is directly contacted with the photosensitive drum; and (2) in order to prevent the vibration caused by the operation of the oil removing roller from affecting a bad influence upon the image, the oil removing roller is driven within the time period other than the time periods during which the photosensitive drum is being exposed and during which the toner image is being transferred from the photosensitive drum to the recording material.

Accordingly, after the last copy is completed, the oil removing roller is driven in such a manner that the operation of the oil removing roller is not overlapped with the transferring operation in order to prevent the operation of the oil removing roller from distorting the transferred image.

Figure 10:
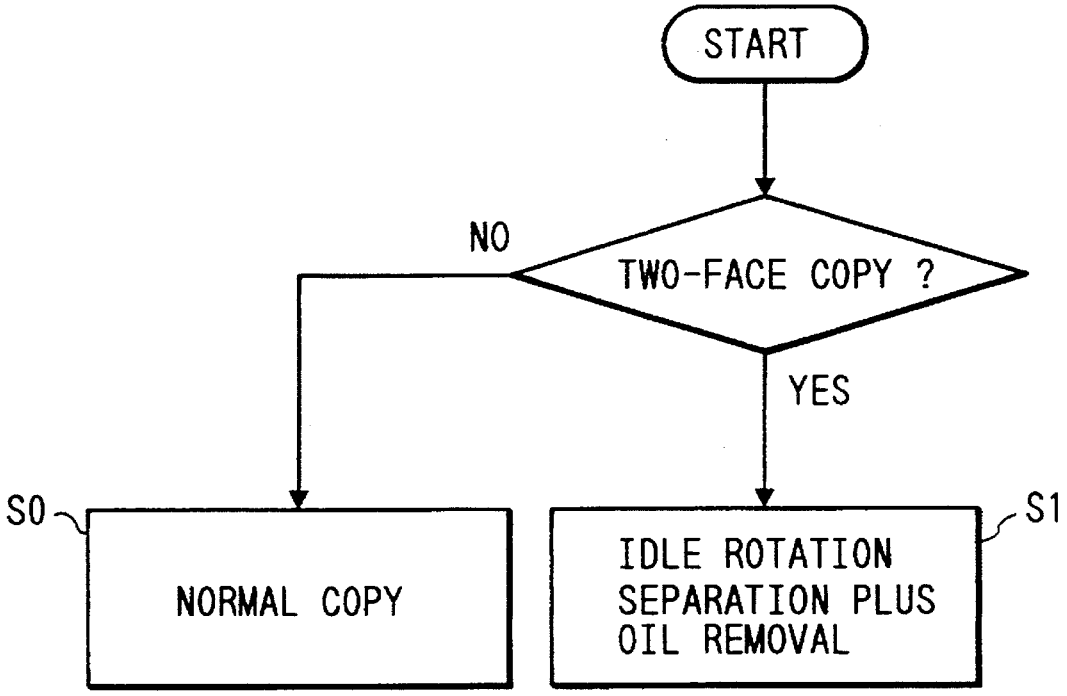
FIG. 10 is a flow chart showing image formation sequence of an image forming apparatus according to a fourth embodiment of the present invention.

FIG. 10 shows a flow chart for selecting the image formation sequence control. First of all, on the basis of the fact whether the copying operation is effected regarding the second surface of the recording material, a normal copy mode S0 or a both-face copy mode S1 is carried out. The normal copy mode S0 is carried out on the basis of the image formation sequence shown in FIG. 11. The both-face copy mode S1 is carried out on the basis of the image formation sequence shown in FIG. 12 to satisfy the above-mentioned fundamental consideration.

In the sequences shown in FIGS. 11 and 12, particularly, the timings of the transfer process, separation process and oil removing process included in the transfer drum processes will be described.

Figure 11:
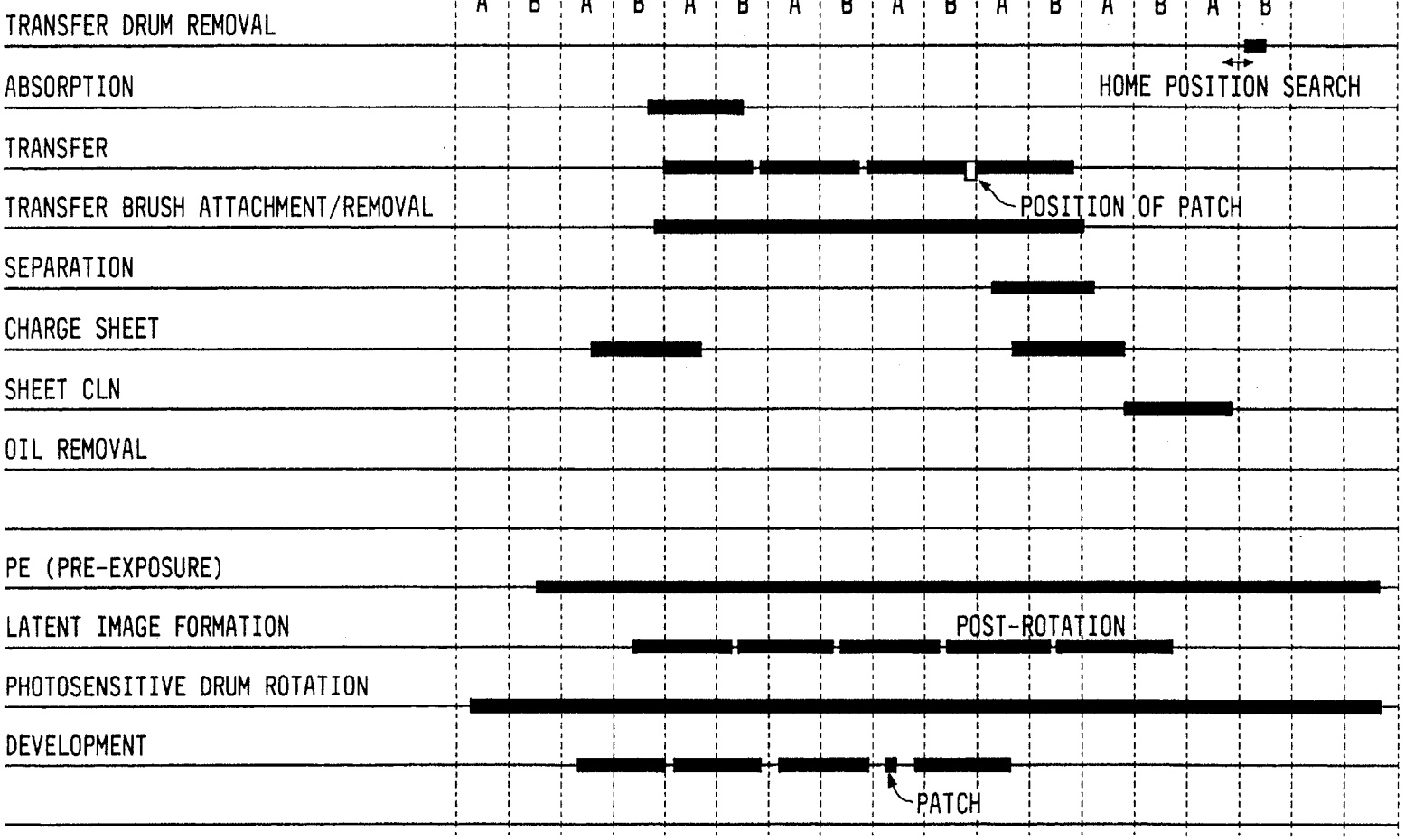
FIG. 11 is a copy sequence chart showing a normal copy mode.

In the sequence as to the normal copy mode S0, as shown in FIG. 11, the transfer process for transferring the last color toner image formed on the photosensitive drum onto the recording material born on the transfer sheet and the separation process for separating the recording material from the transfer sheet are effected simultaneously. In this case, the oil removing roller is not operated.

Figure 12:
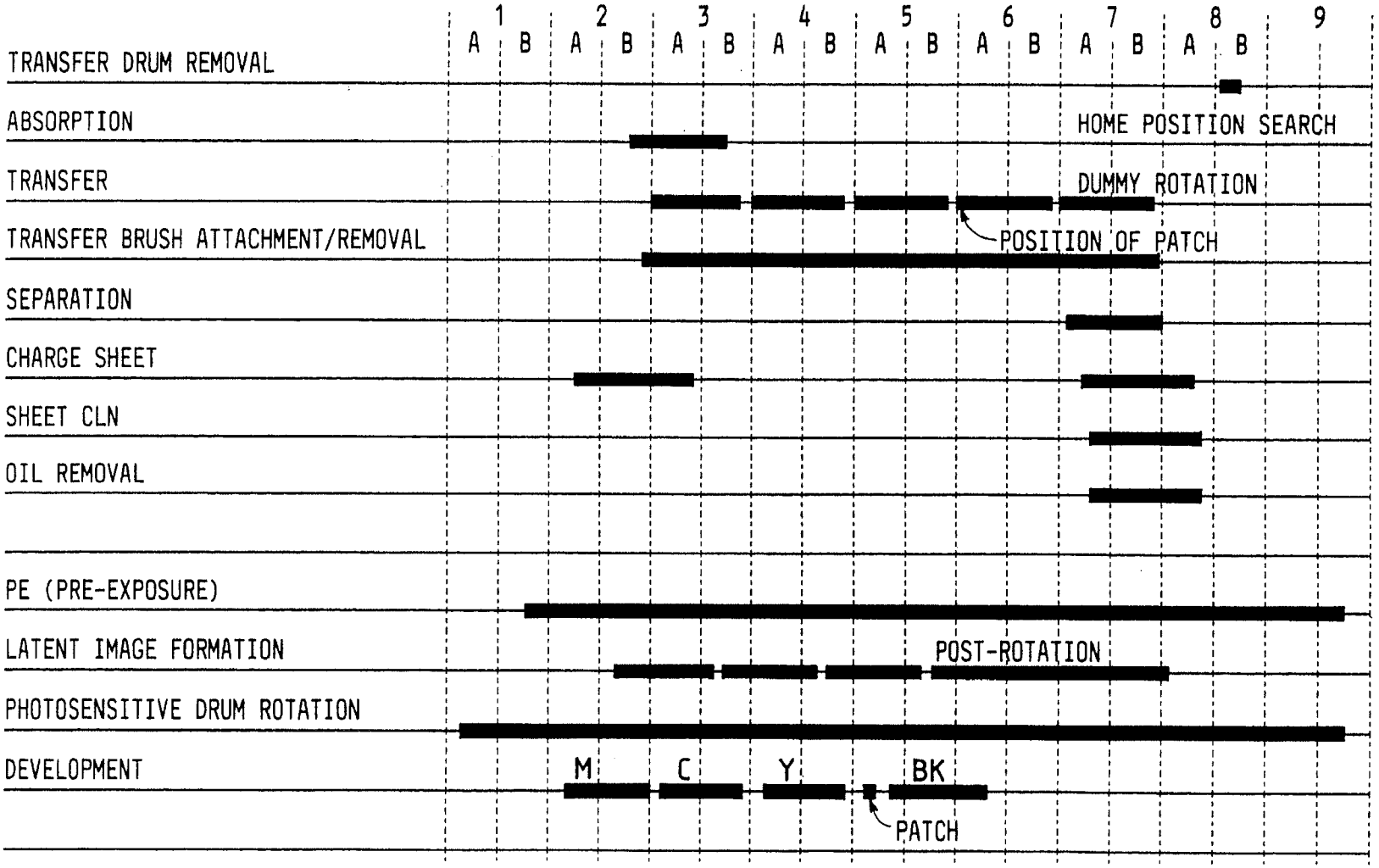
FIG. 12 is a copy sequence chart showing a both-face copy mode according to the fourth embodiment.

On the other hand, in the copy sequence regarding the second surface in the both-face copy mode S1, as shown in FIG. 12, after the last color toner image is transferred onto the recording material, when the transfer drum is rotated to convey the recording material to the transfer station again, i.e., when the transfer drum is rotated idly, the separation process is effected. And, after the transfer process regarding the recording material born on the transfer sheet is finished, the oil removing roller is driven to remove the fixing oil from the transfer sheet.

Incidentally, in this case, the cleaning member such as the fur brush for removing the toner from the transfer sheet is simultaneously driven. The cleaning member is preferably arranged at an upstream side of the oil removing member (roller) in the rotational direction of the transfer drum, in order to prevent the oil removing member from being smudged by the toner.

Fifth Embodiment

Figure 13:
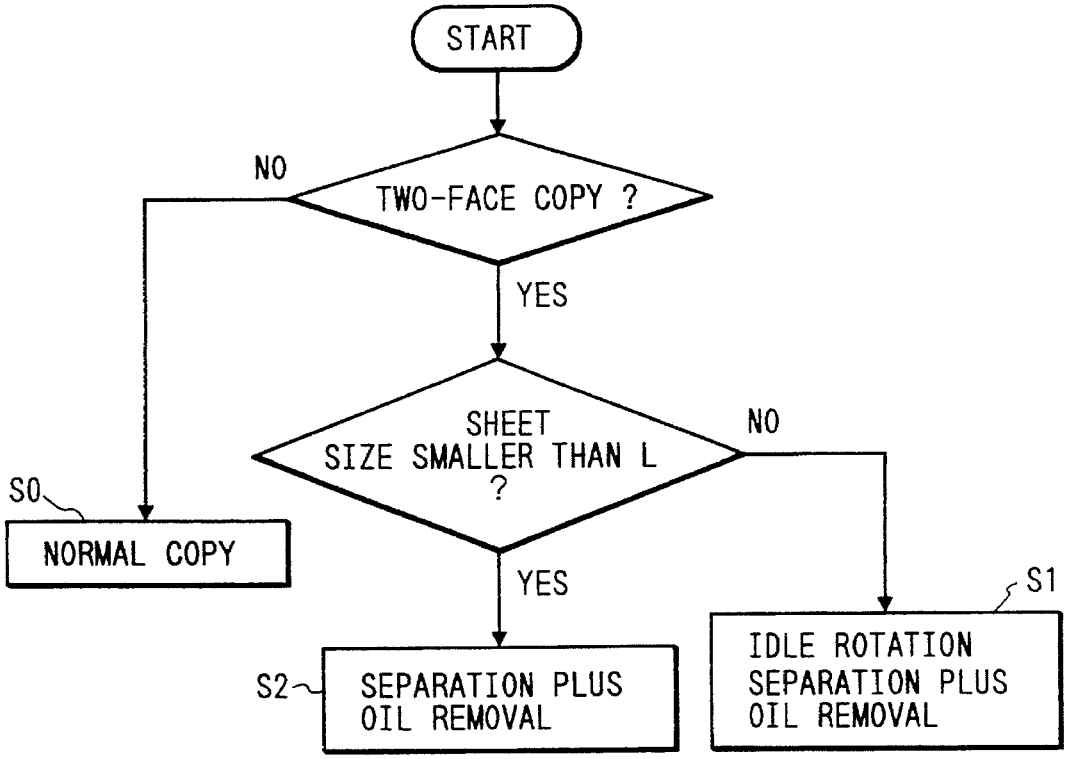
FIG. 13 is a flow chart showing image formation sequence of an image forming apparatus according to a fifth embodiment of the present invention.

Next, an image forming apparatus according to a fifth embodiment of the present invention will be explained with reference to FIGS. 13 and 14. This embodiment is applied to the image forming apparatus of FIG. 4.

The image forming apparatus according to the fifth embodiment has a detection means for detecting the line of the recording material and the length of the recording material and is characterized in that the image formation sequence is controlled on the basis of detection result from the detection means and a distance L between the transfer station and the oil removing roller. For example, when the length of the recording material is small so that the transfer process is not overlapped with the separation process in a time relation, the idle rotation (dummy rotation) of the transfer drum can be omitted.

In the flow chart for selecting the sequence control shown in FIG. 12, first of all, it is judged whether the copying operation is associated with the second surface of the recording material. If it is judged that the copying operation is associated with the second surface, then, the length L1 of the recording material in a recording material conveying direction is compared with the distance L2 between the transfer station and the oil removing roller. If it is judged that the length L1 is greater than the distance L2, the both-face copy mode S1 is carried out. On the other hand, if it is judged that the length L1 is smaller than the distance L2, a second both-face copy mode S2 is carried out.

Figure 14:
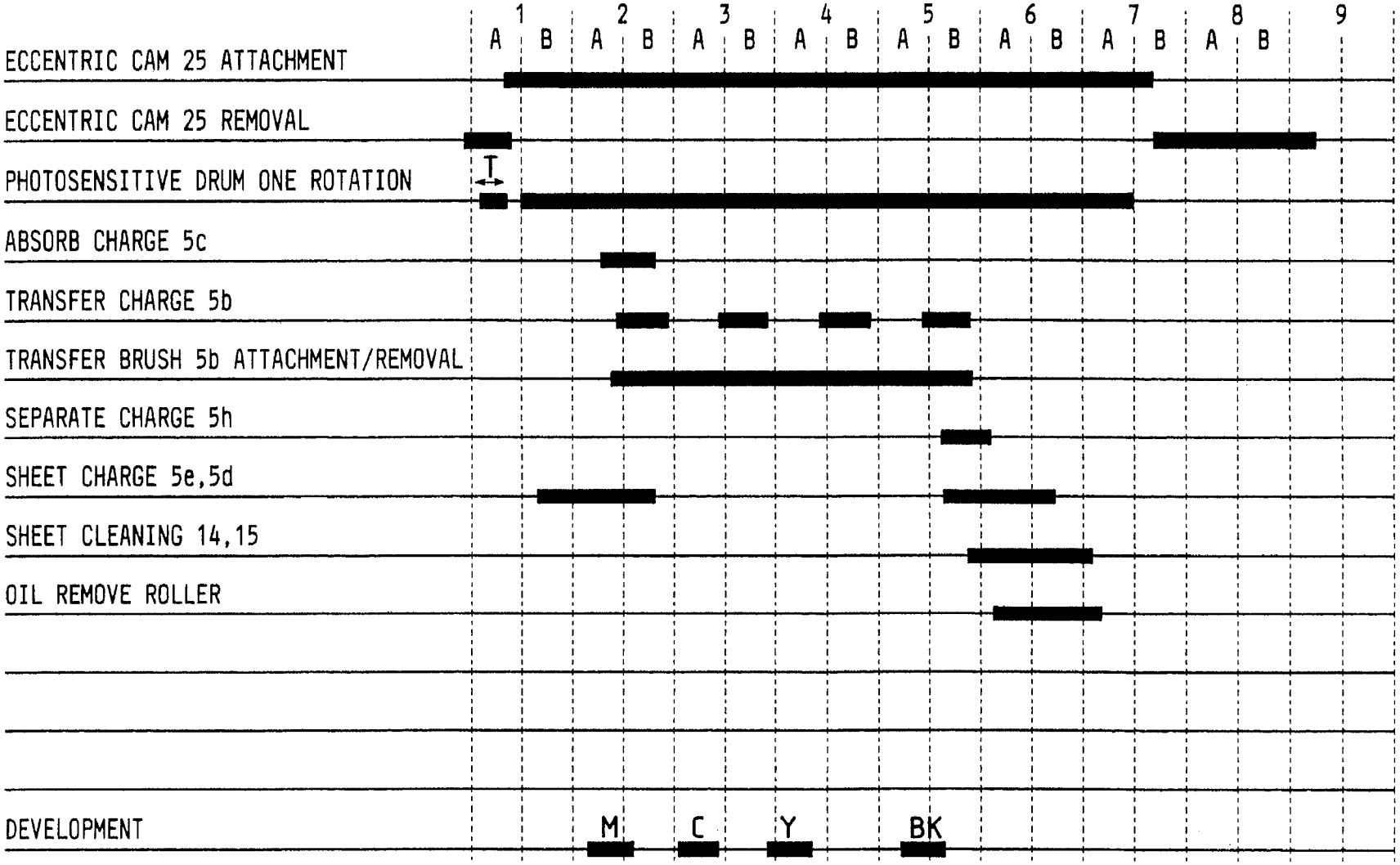
FIG. 14 is a copy sequence chart showing a both-face copy mode according to the fifth embodiment.

In the second both-face copy mode S2, the image formation sequence as shown in FIG. 14 is effected. In this case, since the transfer process is not overlapped with the operation of the oil removing roller in a time relation, the dummy rotation of the transfer drum can be omitted.

Sixth Embodiment

Figure 15:
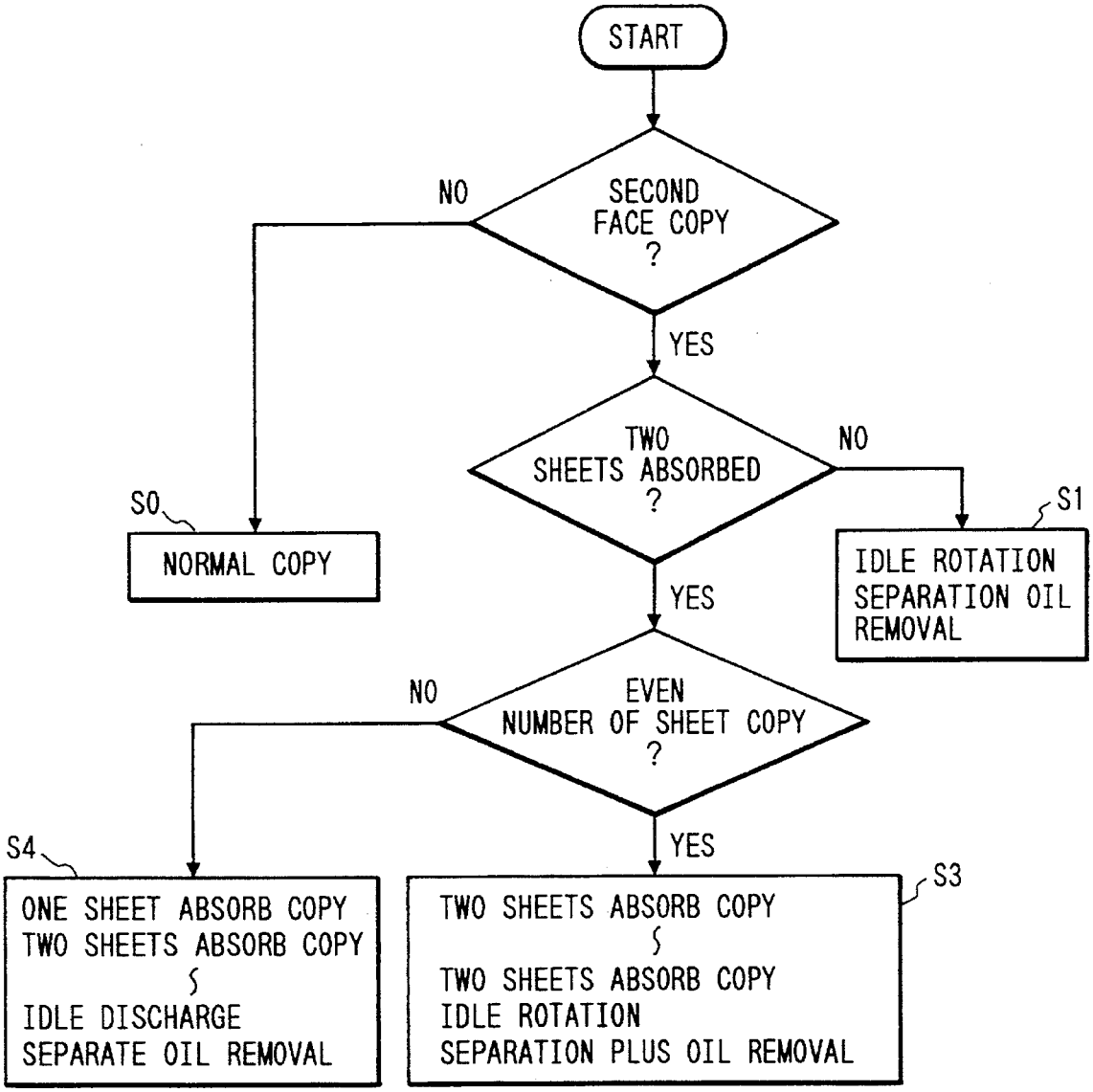
FIG. 15 is a flow chart showing image formation sequence of an image forming apparatus according to a sixth embodiment of the present invention.

Next, an image forming apparatus according to a sixth embodiment of the present invention will be explained with reference to a flow chart shown in FIG. 15. This embodiment is applied to the image forming apparatus of FIG. 4.

When the recording material is held by the transfer sheet of the transfer drum under the action of electrostatic absorption, if the peripheral length of the transfer drum is greater than twice of the length of the recording material, two or more recording materials are born on the transfer drum simultaneously to effect the multi transferring. With this arrangement, the through-put in the continuous copying operation can be increased.

In this embodiment, the image formation in a system wherein two recording materials can be absorbed onto the transfer sheet will be described. In such a system, when an even number of recording materials are copied, the fixing oil adhered to the transfer sheet is not transferred onto the photosensitive drum since any recording material always exists at the transfer station. However, when an odd number of recording materials are copied, in the last copying operation, since only one recording material is absorbed onto the transfer sheet, the transfer sheet to which the fixing oil was adhered is directly contacted with the photosensitive drum at the transfer station, with the result that the fixing oil is transferred onto the photosensitive drum. In order to prevent the fixing oil from transferring to the photosensitive drum, the sequence control is effected in accordance with the flow chart as shown in FIG. 15.

First of all, it is judged whether the normal copy mode S0 is effected or the second both-face copy mode is effected on the basis of the fact whether the copying operation is associated with the second surface of the recording material.

Then, if it is judged that the copying operation is associated with the second surface, it is judged whether two recording materials can be absorbed on the transfer drum. The recording materials which cannot be absorbed simultaneously or a recording material having small size are copied in the normal copy mode S0. In the case where two recording materials having small size are simultaneously absorbed on the transfer drum, when the number of the recording materials to be copied is even, a third copy mode S3 is carried out, and, when the number of the recording materials to be copied is odd, a fourth copy mode S4 having the image formation sequence different from the third copy mode is carried out.

In case of the sequence in the third copy mode S3, two sheets absorption and the transferring are repeated, and, in the sequence regarding the last two recording materials, the dummy rotation of the transfer drum is effected, during which the recording materials are separated from the transfer drum and the oil is removed from the transfer sheet. On the other hand, in case of the sequence in the third copy mode S4, first of all, a single recording material is copied so that the remaining number of recording materials becomes even. Then, two sheets absorption and the transferring are repeated. By absorbing the single recording material onto the transfer drum firstly, it is possible to prevent the transfer sheet to which the fixing oil was adhered from directly contacting with the photosensitive drum in the further copying operations.

Seventh Embodiment

Figure 16:
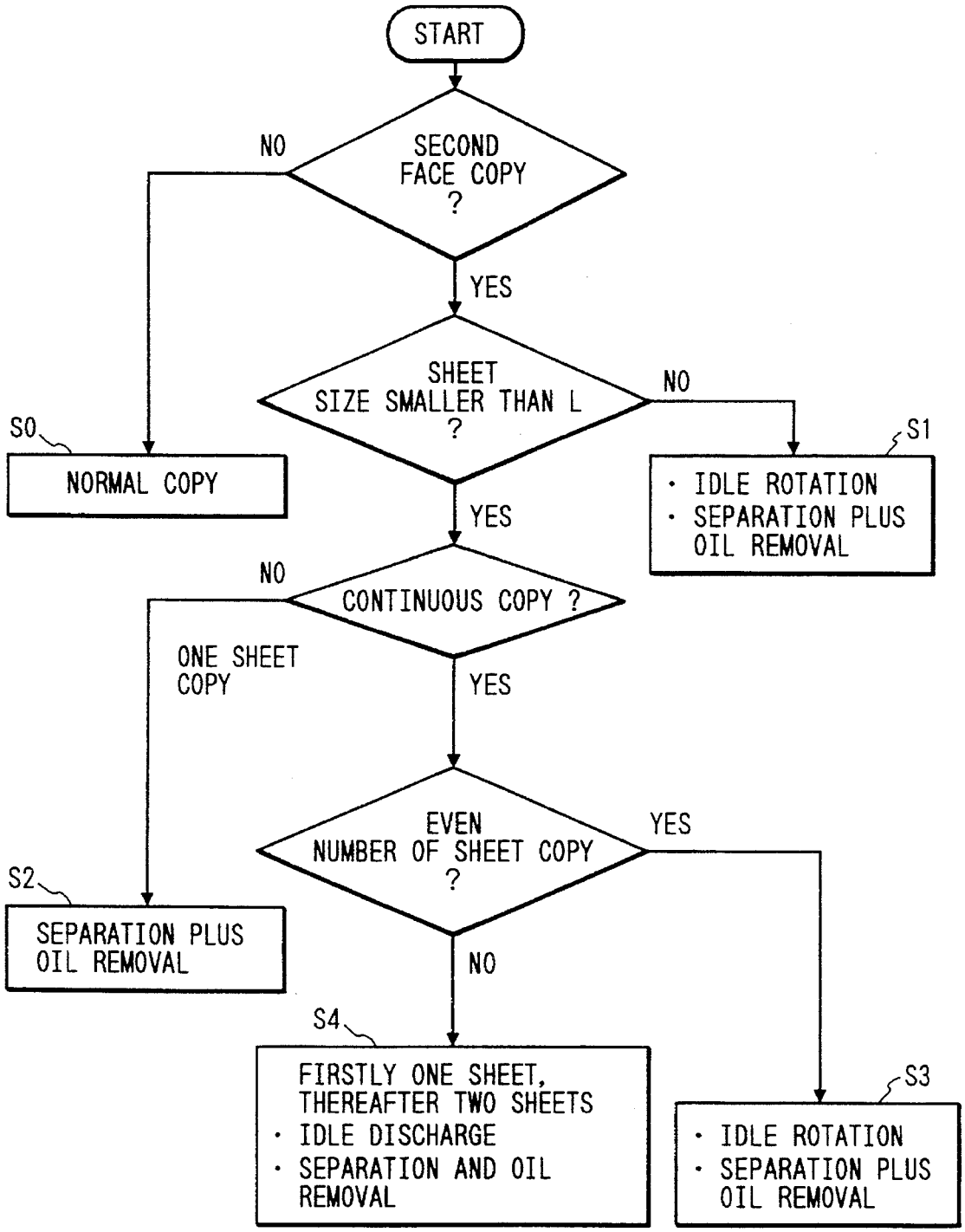
FIG. 16 is a flow chart showing image formation sequence of an image forming apparatus according to a seventh embodiment of the present invention.

Next, an image forming apparatus according to a seventh embodiment of the present invention will be explained with reference to a flow chart regarding the image formation sequence, as shown in FIG. 16. This embodiment is applied to the image forming apparatus of FIG. 4.

In this embodiment, in the second both-face copy mode of the image forming apparatus capable of electrostatically absorbing two recording materials on the transfer drum simultaneously, first of all, the both-face sequence is selected in accordance with the length L1 of the recording material. If the length L1 of the recording material is smaller than the distance L between the separation means and the fixing means, the second both-face copy sequence is selected on the basis of the fact whether a plurality of recording materials should be electrostatically absorbed on the transfer drum.

First of all, it is judged whether the copying operation is associated with the second surface of the recording material. If not, the normal copy mode S0 is carried out. On the other hand, if the copying operation is associated with the second surface and when the length L1 of the recording material is greater than the distance L2 between the transfer station and the oil removing roller, the both-face copy mode S1 is carried out. Further, if the copying operation is associated with the second surface and when the length L1 of the recording material is smaller than the distance L2 between the transfer station and the oil removing roller and when the single recording material is copied, the second both-face copy mode S2 is carried out.

Further, if the copying operation is associated with the second surface and when the length L1 of the recording material is smaller than the distance L2 between the transfer station and the oil removing roller and when the even number of recording materials are continuously copied, the third copy mode S3 is carried out. If the copying operation is associated with the second surface and when the length L1 of the recording material is smaller than the distance L2 between the transfer station and the oil removing roller and when the odd number of recording materials are continuously copied, the fourth copy mode S4 is carried out.

Now, the wording "firstly one sheet, thereafter two sheets" in FIG. 16 means that, regarding the recording materials which can be born on the transfer drum simultaneously, when the odd number of recording materials are continuously copied, a single recording material is firstly born on the transfer drum, and, thereafter, two recording materials are born on the transfer drum simultaneously. For example, when five recording materials having A4 size are continuously copied, a single recording material is firstly born on the transfer drum, and then two recording materials are born on the transfer drum, and, lastly, two recording materials are born on the transfer drum.

Eighth Embodiment

Figure 17:
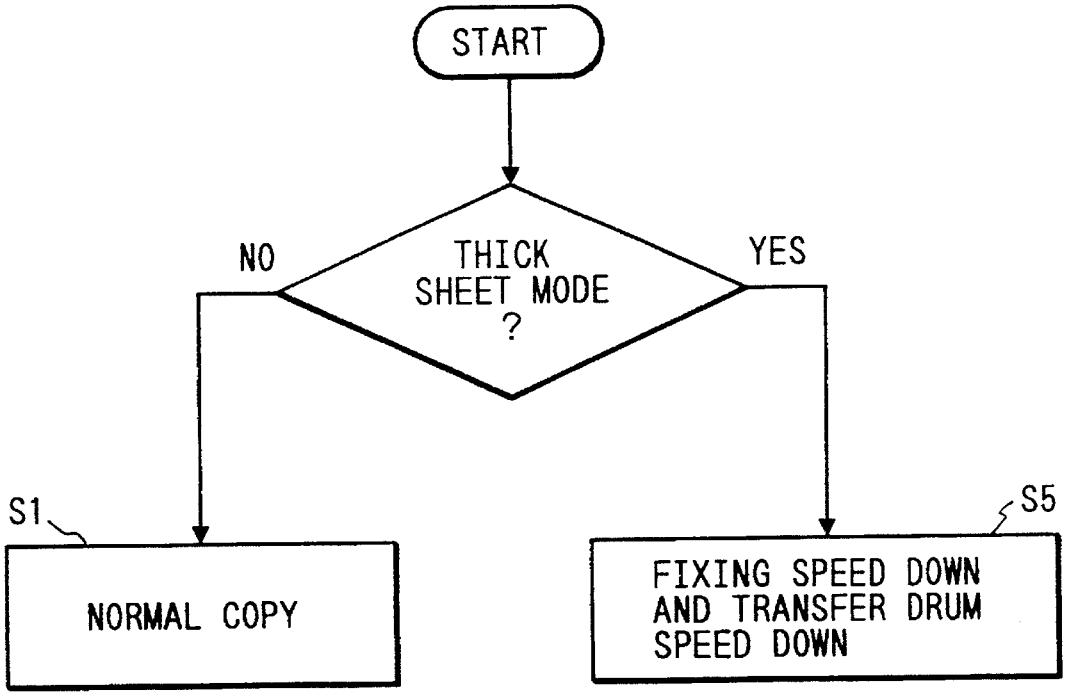
FIG. 17 is a flow chart showing image formation sequence of an image forming apparatus according to an eighth embodiment of the present invention.

Next, an image forming apparatus according to an eighth embodiment of the present invention will be explained with reference to a flow chart regarding the image formation sequence, as shown in FIG. 17. This embodiment is applied to the image forming apparatus of FIG. 4.

When, for example, a recording material such as a thick sheet or an OHP sheet is designated on the basis of information regarding the kind of the recording material and it is judged that the fixing speed should be changed on the basis of the designation, this embodiment is adopted (this is referred to as "thick sheet mode" hereinafter).

In this embodiment, in the thick sheet mode, after the last color toner image is transferred onto the recording material, the dummy rotation of the transfer drum is effected, and the transfer drum speed and the fixing roller speed are selected in accordance with information regarding the recording material, and, after the recording material is separated from the transfer drum, the image is fixed to the recording material. That is to say, the sequence is controlled on the basis of an output from a detection or designation means for the thick sheet, OHP sheet or the like.

As shown in FIG. 17, in the flow chart for selecting the sequence control, first of all, it is judged whether the normal copy mode S0 is effected or the thick sheet mode S5 is effected on the basis of the fact whether the fixing condition should be changed or not.

Figure 18:
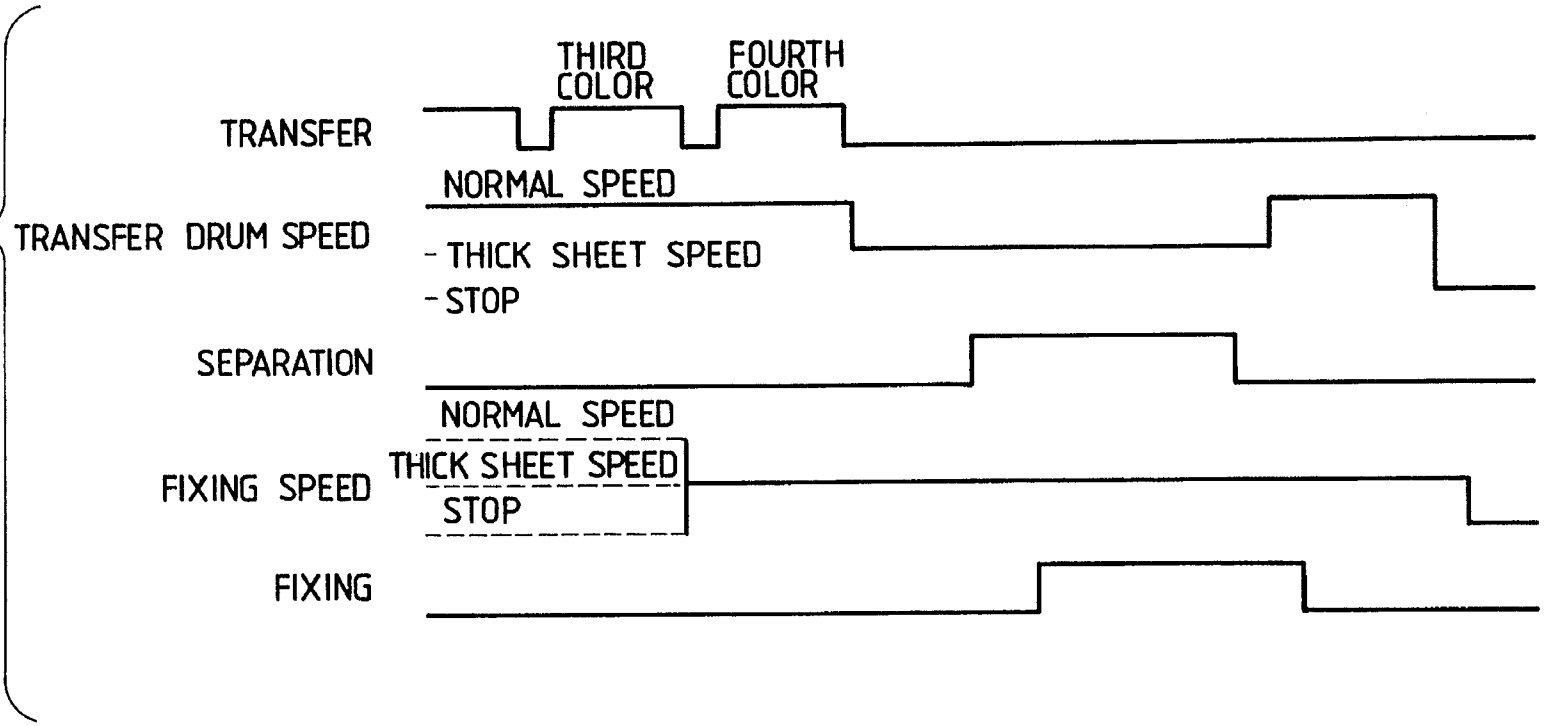
FIG. 18 is a copy sequence chart showing a both-face copy mode according to the eighth embodiment.

Now, the sequence as to the thick sheet mode S5 will be explained with reference to a timing chart shown in FIG. 18. In FIG. 18, the timing for switching the drive speed of the transfer drum, the timing for transferring the toner image from the photosensitive drum onto the single recording material born on the transfer drum, the separation timing and the timing for effecting the fixing operation are shown. As shown in FIG. 18, after the transferring operation, the rotational speed of the transfer drum is changed in accordance with the fixing speed. Then, after the recording material to which the toner images were multi-transferred passes through the transfer station again while the recording material being held by the transfer drum (i.e., during the dummy rotation of the transfer drum), the recording material is separated from the transfer sheet, and then the toner images are fixed to the recording material.

Incidentally, the settings of the potential of the photosensitive drum and the condition of the transferring in the dummy rotation of the transfer drum are substantially the same as those in the normal copying operation.

Ninth Embodiment

Figure 19:
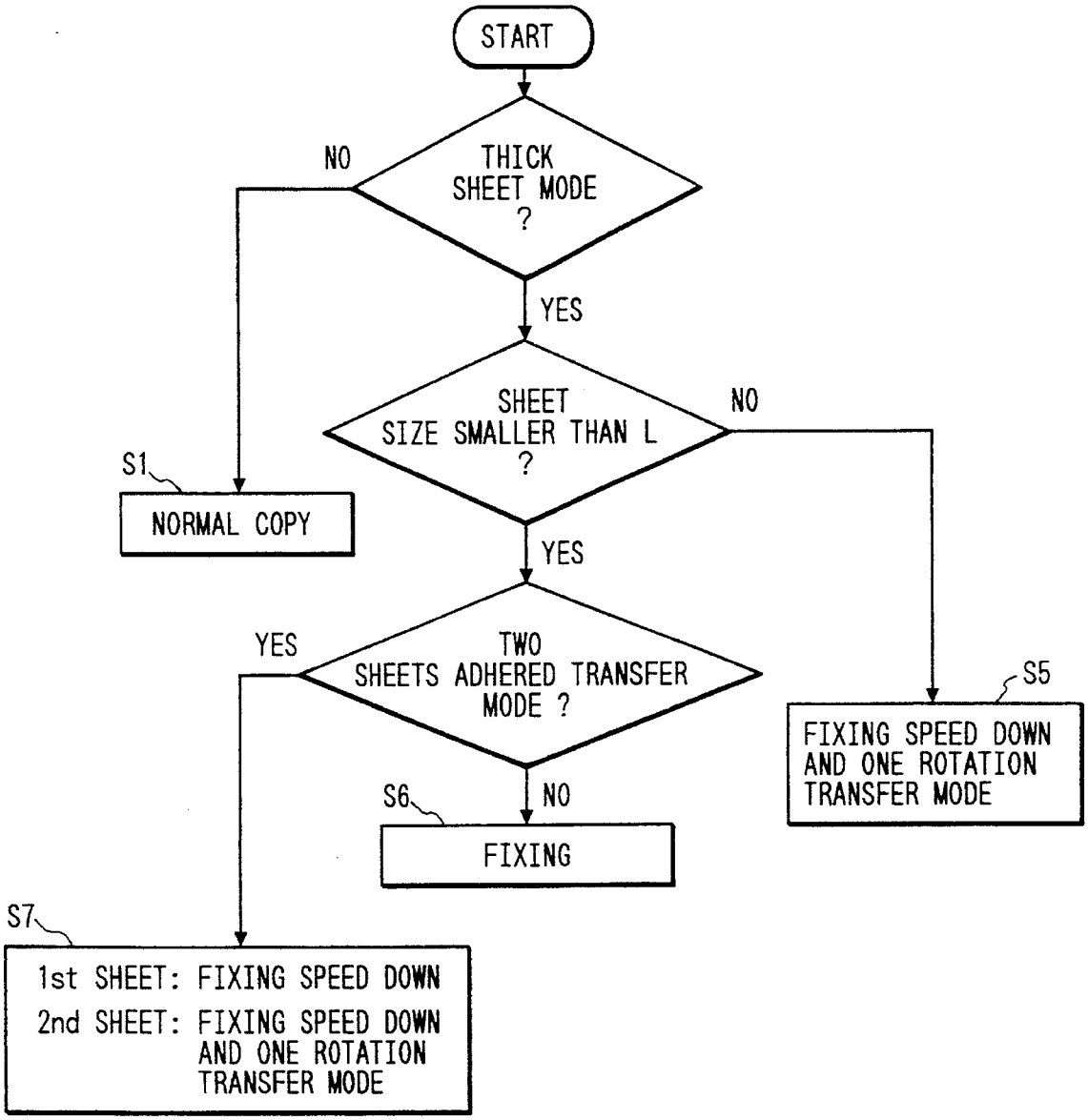
FIG. 19 is a flow chart showing image formation sequence of an image forming apparatus according to a ninth embodiment of the present invention.

Next, an image forming apparatus according to a ninth embodiment of the present invention will be explained with reference to a flow chart regarding the image formation sequence, as shown in FIG. 19. This embodiment is applied to the image forming apparatus of FIG. 4.

The image forming apparatus according to this embodiment includes a selection means for selecting the kind and length of the recording material, a fixing speed selection means, and a transfer drum speed selection means for selecting the speed of the transfer drum in accordance with the selected fixing speed, and is designed so that, after the last color toner image is transferred onto the recording material, the transfer drum speed and the fixing roller speed are selected on the basis of information regarding the recording material, and, after the recording material is separated from the transfer drum, the toner image is fixed to the recording material. That is to say, the image forming apparatus includes a detection or designation means for the thick sheet, and a detection means for detecting the size of the recording material, and the sequence is controlled on the basis of outputs from these means.

As shown in FIG. 19, in the flow chart for selecting the sequence control, first of all, it is judged whether the normal copy mode S0 is effected or the thick sheet mode S5 is effected on the basis of the fact whether the fixing condition should be changed or not.

In the thick sheet mode, the distance L between the separation means and the fixing means, and the length L1 of the recording material is compared. If the length L1 is greater than the distance L, a fifth copy mode S5 is carried out.

On the other hand, if the length L1 is smaller than the distance L, it is judged whether a plurality of recording materials should be electrostatically absorbed on the transfer sheet. If it is judged that the single recording material is copied, a sixth copy mode S6 is carried out. On the other hand, if it is judged that the plurality of recording materials should be held on the transfer sheet, a seventh copy mode S7 is carried out.

Next, the sequences regarding the fifth, sixth and seventh copy modes S5, S6, S7 will be explained with reference to timing charts. The sequences which will be described later show the timing for switching the driving speed of the transfer drum, the timing for transferring the toner image from the photosensitive drum onto the single recording material born on the transfer drum, the separation timing and the timing for effecting the fixing operation.

In the sequence regarding the fifth copy mode S5, as shown in the above-mentioned timing chart of FIG. 18, after the transferring operation, the rotational speed of the transfer drum is changed in accordance with the selected fixing speed. Then, after the recording material to which the toner images were multi-transferred passes through the transfer station again while the recording material being held by the transfer drum (i.e., during the dummy rotation of the transfer drum), the recording material is separated from the transfer drum, and the toner images are fixed to the recording material.

Figure 20:
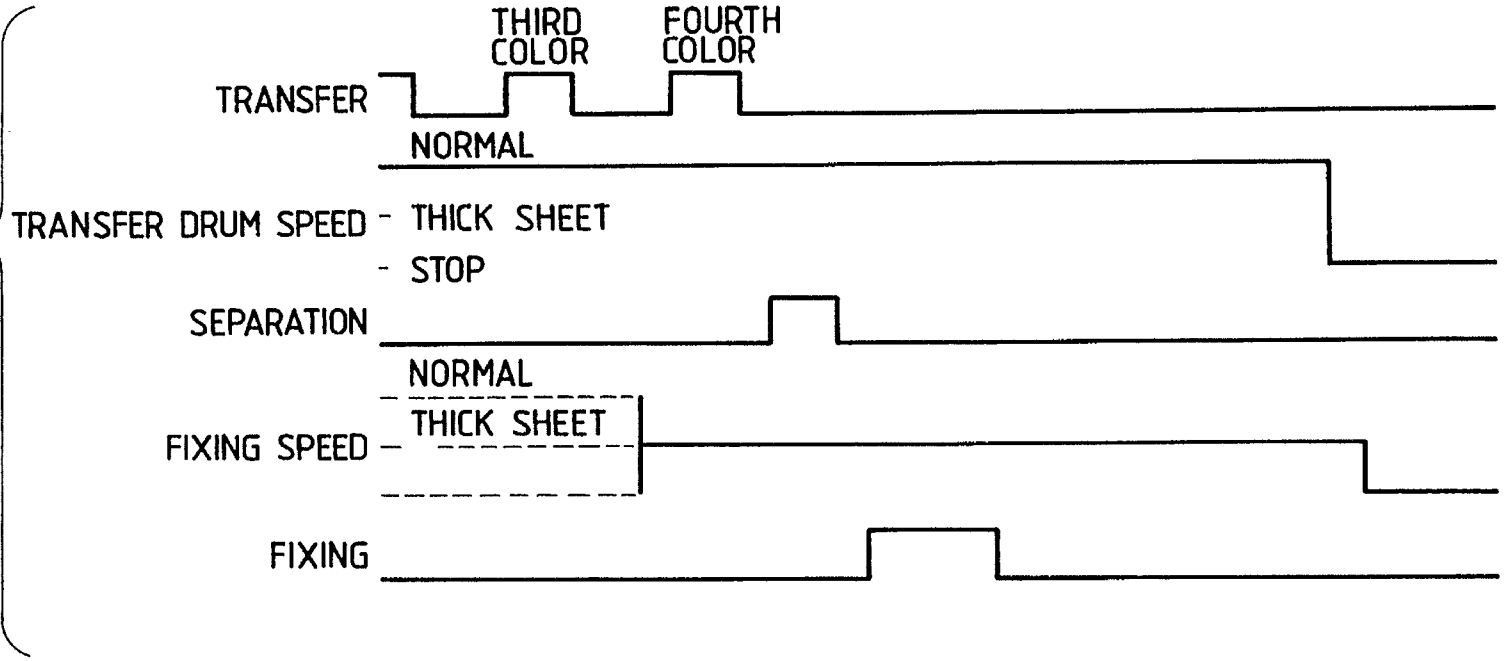
FIG. 20 is a copy sequence chart showing a copy mode (S6) according to the ninth embodiment.

In the sequence regarding the sixth copy mode S6 for the single recording material, as shown in FIG. 20, after the transferring operation, the recording material is separated from the transfer drum, and the toner image is fixed to the recording material.

Figure 21:
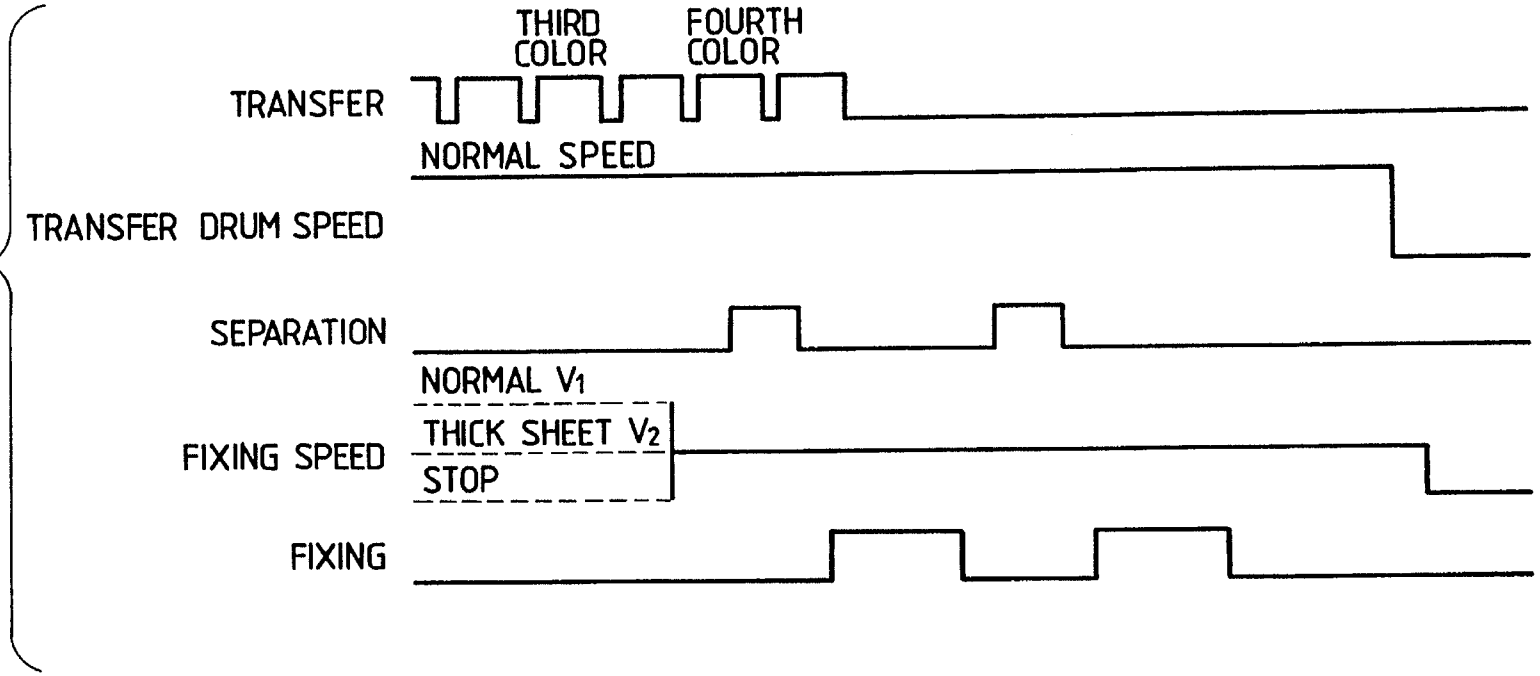
FIG. 21 is a copy sequence chart showing a copy mode (S7) according to the ninth embodiment.

When the plurality of recording materials are born on the transfer drum, i.e., in the sequence regarding the seventh copy mode S7, as shown in FIG. 21, after the transferring operation, firstly, the single recording material to which the toner image was transferred is separated from the transfer drum, and the toner image is fixed to the recording material. Regarding other recording materials, after the recording material to which the toner images were multi-transferred passes through the transfer station again while the recording material being held by the transfer drum (i.e., during the dummy rotation of the transfer drum), the recording material is separated from the transfer drum, and the toner images are fixed to the recording material. In this case, several dummy rotations of the transfer drum are effected so that the separated recording material is not overlapped with the fixing of the first recording material.

Incidentally, the settings of the potential of the photosensitive drum and the transferring condition in the dummy rotation(s) of the transfer drum are the same as those in the normal copying operation.

The present invention is not limited to the above-mentioned embodiments, various alterations and modifications can be effected within the scope of the invention.

What is claimed is:

1. An image forming apparatus comprising:

an image bearing member for bearing an image;

a rotatable recording material bearing member for bearing a recording material and for conveying the recording material to a transfer station, wherein the image borne on said image bearing member is transferred onto the recording material borne on said recording material bearing member at said transfer station; and control means for controlling driving of said recording material bearing member and separation of the recording material from the recording material bearing member, wherein when a length (L1) of a single recording material borne on said recording material bearing member in a rotational direction of said recording material bearing member is greater than a predetermined length, after completion of transfer of the image onto the recording material, said recording material borne on said recording material bearing member is conveyed to said transfer station again, and when said length (L1) is not greater than said predetermined length, after completion of transfer of the image onto the recording material, said recording material borne on said recording material bearing member is separated from said recording material bearing member without being transferred to said transfer station again.

2. An image forming apparatus according to claim 1, further comprising contact means which contacts with and separates from a surface of said recording material bearing member, wherein said predetermined length is substantially equal to a distance from said transfer station to a contact position of said contact means along the rotational direction of said recording material bearing member.

3. An image forming apparatus according to claim 1, further comprising cleaning means which contacts with the surface of said recording material bearing member at a cleaning station to clean said surface of said recording material bearing member, wherein said predetermined length is substantially equal to a distance (L2) from said transfer station to said cleaning station along the rotational direction of said recording material bearing member.

4. An image forming apparatus according to claim 3, wherein, after transfer of the image onto the recording material is completed, said cleaning means starts to clean a surface of said recording material bearing member.

5. An image forming apparatus according to claim 3, wherein, after the image is transferred onto a first surface of the recording material, an image is transferred onto a second surface of said recording material.

6. An image forming apparatus according to claim 5, further comprising fixing means for fixing the image onto the recording material, wherein said fixing means includes a fixing rotary member which contacts with a surface of the recording material having a non-fixed image thereon, and wherein a mold releasing agent is applied to said fixing rotary member.

7. An image forming apparatus according to claim 6, wherein, when the image is transferred onto the second surface of the recording material, if said length (L1) is greater than said distance (L2), after the image transfer onto the second surface of the recording material is completed, the recording material borne on said recording material bearing member is conveyed to said transfer station again, and when the image is transferred onto the second surface of the recording material, if said length (L1) is not greater than said distance (L2), after the image transfer onto the recording material is completed, the recording material borne on said recording material bearing member is separated from said recording material bearing member without being conveyed to said transfer station again.

8. An image forming apparatus according to claim 7, wherein, when the image is transferred onto the first surface of the recording material, if said length (L1) is not greater than said distance (L2), after the image transfer onto the first surface of the recording material is completed, the recording material borne on said recording material bearing member is separated from said recording material bearing member without being conveyed to said transfer station again by said recording material bearing member.

9. An image forming apparatus according to claim 6, 7 or 8, wherein said cleaning means cleans a mold releasing agent adhered to the surface of said recording material bearing member.

10. An image forming apparatus according to any one of claims 5 to 8, wherein an area of said recording material bearing member on which the first surface of the recording material was borne is not passed through said transfer station without bearing the recording material until said area is cleaned by said cleaning means.

11. An image forming apparatus according to claim 10, wherein said cleaning means cleans a mold releasing agent adhered to the surface of said recording material bearing member.

12. An image forming apparatus according to any one of claims 3 to 8, wherein said cleaning means contacts with and separates from said recording material bearing member, and wherein said cleaning means is separated from said recording material bearing member until transfer of the image onto the recording material is finished.

13. An image forming apparatus according to claim 1, wherein a plurality of color images are transferred onto the recording material borne on said recording material bearing member in a superposed fashion.

14. An image forming apparatus according to claim 13, wherein a full-color image is formed on the recording material.

15. An image forming apparatus comprising:

an image bearing member for bearing an image;

a rotatable recording material bearing member for bearing a recording material and for conveying the recording material to a transfer station, wherein said recording material bearing member is capable of bearing a plurality of recording materials simultaneously, and wherein the image borne on said image bearing member is transferred onto a recording material borne on said recording material bearing member at said transfer station; and control means for controlling driving of said recording material bearing member and separating of the recording material from said recording material bearing member, so that when a plurality of recording materials are borne on said recording material bearing member simultaneously and a distance (L1) from a leading end of a first recording material to a trailing end of a last recording material in a rotational direction of said recording material bearing member is greater than a predetermined length, after completion of transfer of images onto the plurality of recording materials, each of said recording materials borne on said recording material bearing member is conveyed to said transfer station again, and when said distance (L1) is not greater than said predetermined length, after completion of transfer of the image onto each of the plurality of recording materials, each of said recording materials borne on said recording material bearing member is separated from said recording material bearing member without being transferred to said transfer station again.

16. An image forming apparatus according to claim 15, further comprising contact means which contacts with and separates from a surface of said recording material bearing member, wherein said predetermined length is substantially equal to a distance from said transfer station to a contact position of said contact means along the rotational direction of said recording material bearing member.

17. An image forming apparatus according to claim 15, further comprising cleaning means which contacts with the surface of said recording material bearing member at a cleaning station to clean said surface of said recording material bearing member, wherein said predetermined length is substantially equal to a distance (L2) from said transfer station to said cleaning station along the rotational direction of said recording material bearing member.

18. An image forming apparatus according to claim 17, wherein, after an image is transferred onto a recording material, said cleaning means starts to clean the surface of said recording material bearing member.

19. An image forming apparatus according to claim 17, wherein, after completion of image transfer onto a first surface of the recording material, an image is transferred onto a second surface of said recording material.

20. An image forming apparatus according to claim 19, further comprising fixing means for fixing the image onto the recording material, wherein said fixing means includes a fixing rotary member which contacts with a surface of the recording material having a non-fixed image thereon, and wherein a mold releasing agent is applied to said fixing rotary member.

21. An image forming apparatus according to claim 20, wherein, when the image is transferred onto the second surface of the recording material, if said distance (L1) is greater than said distance (L2), after completion of image transfer of the images onto each of the plurality of recording materials, the plurality of recording materials borne on said recording material bearing member are conveyed to said transfer station again, and, when the image is transferred onto the second surface of the recording material, if said distance (L1) is not greater than said distance (L2), after the images are transferred onto the plurality of recording materials, the plurality of recording materials borne on said recording material bearing member are separated from said recording material bearing member without being conveyed to said transfer station again.

22. An image forming apparatus according to claim 21, wherein, when the image is transferred onto the first surface of the recording material, if said distance (L1) is not greater than said distance (L2), after completion of transfer of images onto each of the plurality of recording materials, the plurality of recording materials borne on said recording material bearing member are separated from said recording material bearing member without being conveyed to said transfer station again.

23. An image forming apparatus according to claim 20, 21 or 22, wherein said cleaning means cleans a mold releasing agent adhered to the surface of said recording material bearing member.

24. An image forming apparatus according to any one of claims 19 to 22, wherein an area of said recording material bearing member on which the first surface of the recording material was borne is not passed through said transfer station without bearing the recording material until said area is cleaned by said cleaning means.

25. An image forming apparatus according to claim 24, wherein said cleaning means cleans a mold releasing agent adhered to the surface of said recording material bearing member.

26. An image forming apparatus according to any one of claims 17 to 22, wherein said cleaning means contacts with and separates from said recording material bearing member, and wherein said cleaning means is separated from said recording material bearing member until transfer of the image onto the recording material is finished.

27. An image forming apparatus according to claim 15, wherein a plurality of color images are transferred onto the recording material borne on said recording material bearing member in a superposed fashion.

28. An image forming apparatus according to claim 27, wherein a full-color image is formed on the recording material.

29. An image forming apparatus comprising:

an image bearing member for bearing a plurality of images of different colors;

a rotatable recording material bearing member for bearing a recording material and for conveying the recording material to a transfer station, wherein said plurality of images of different colors borne on said image bearing member are transferred onto the recording material borne on said recording material bearing member at said transfer station;

cleaning means, which contacts with and separates from a surface of said recording material bearing member at a cleaning position, for cleaning a separate-mold agent from said recording material bearing member; and determining means for determining whether to convey the recording material borne on said recording material bearing member to the transfer station again after completion of image transfer onto the recording material based on a time period from a start of image transfer of a last color image to the recording material to a start of contact of said cleaning means with said recording material bearing member.

30. An image forming apparatus according to claim 29, wherein contact of said cleaning means with said recording material bearing member starts after completion of image transfer of the last color image to the recording material regardless of the time period from the start of the image transfer of the last color image to the recording sheet to the start of the contact of said cleaning means with said recording material bearing member.

31. An image forming apparatus according to claim 29, wherein, after an image is transferred onto a first surface of the recording material, an image can be transferred onto a second surface of said recording material.

32. An image forming apparatus according to claim 31, further comprising fixing means for fixing an image onto a surface of the recording material, wherein said fixing means includes a fixing rotary member which contacts with a surface of the recording material having a non-fixed image thereon, and wherein a mold releasing agent is applied to said fixing rotary member.

33. An image forming apparatus according to claim 29, wherein a full-color image is formed on the recording material.

* * * * *